US011998810B1

(12) United States Patent
Day et al.

(10) Patent No.: US 11,998,810 B1
(45) Date of Patent: Jun. 4, 2024

(54) REVERSIBLE SOLE PLATE FOR A GOLF CLUB HEAD

(71) Applicant: Cobra Golf Incorporated, Carlsbad, CA (US)

(72) Inventors: Cameron J. Day, Vista, CA (US); Bryce W. Hobbs, Carlsbad, CA (US); Ryan L. Roach, Encinitas, CA (US); Michael T. McDonnell, Carlsbad, CA (US); Michael S. Yagley, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 17/948,778

(22) Filed: Sep. 20, 2022

Related U.S. Application Data

(60) Provisional application No. 63/245,993, filed on Sep. 20, 2021.

(51) Int. Cl.
*A63B 53/04* (2015.01)
*A63B 53/08* (2015.01)

(52) U.S. Cl.
CPC ..... *A63B 53/0433* (2020.08); *A63B 53/0416* (2020.08); *A63B 53/0466* (2013.01); *A63B 53/08* (2013.01); *A63B 2053/0491* (2013.01)

(58) Field of Classification Search
CPC . A63B 53/0433; A63B 53/0466; A63B 53/06; A63B 2053/0491; A63B 2102/32
See application file for complete search history.

(56) References Cited

U.S. PATENT DOCUMENTS

| | | | | | |
|---|---|---|---|---|---|
| 1,774,590 | A * | 9/1930 | Buhrke | A63B 53/04 | 473/328 |
| 2,163,091 | A * | 6/1939 | Held | A63B 60/02 | 473/338 |
| 3,143,349 | A * | 8/1964 | MacIntyre | A63B 53/0487 | 473/338 |
| 4,553,755 | A * | 11/1985 | Yamada | A63B 53/04 | 473/346 |
| 5,518,243 | A * | 5/1996 | Redman | A63B 53/04 | 473/334 |
| 5,916,042 | A * | 6/1999 | Reimers | A63B 53/04 | 473/345 |
| 6,033,318 | A * | 3/2000 | Drajan, Jr. | A63B 60/54 | 473/309 |
| 6,089,994 | A * | 7/2000 | Sun | A63B 60/02 | 473/341 |
| 7,108,609 | B2 * | 9/2006 | Stites | A63B 53/06 | 473/335 |
| 7,153,220 | B2 * | 12/2006 | Lo | A63B 60/00 | 473/340 |
| 7,934,999 | B2 * | 5/2011 | Cackett | A63B 60/00 | 473/244 |

(Continued)

*Primary Examiner* — William M Pierce
(74) *Attorney, Agent, or Firm* — Quarles & Brady LLP

(57) ABSTRACT

A golf club head can include a body having a toe region and a heel region. The golf club body defines an opening to an internal cavity of the body and the opening is surrounded by a perimeter. The golf club head includes a face, a first support member, and a sole plate supported by the first support member and secured to the body at the perimeter. The sole plate is configured to be secured to the body in a plurality of arrangements.

19 Claims, 19 Drawing Sheets

(56) References Cited

U.S. PATENT DOCUMENTS

| | | | | |
|---|---|---|---|---|
| 8,721,472 | B2 * | 5/2014 | Kuan | A63B 53/0487 473/340 |
| 8,747,253 | B2 * | 6/2014 | Stites | A63B 60/02 473/345 |
| 8,876,622 | B2 * | 11/2014 | Beach | A63B 53/06 473/244 |
| 9,033,813 | B2 * | 5/2015 | Oldknow | A63B 60/02 473/344 |
| 9,259,627 | B1 * | 2/2016 | Myers | A63B 53/04 |
| 9,623,302 | B1 * | 4/2017 | Myers | A63B 53/0466 |
| 9,873,029 | B1 * | 1/2018 | Sillies | A63B 60/02 |
| 10,004,954 | B2 * | 6/2018 | Chen | A63B 53/0466 |
| 10,022,599 | B1 * | 7/2018 | Jorgensen | A63B 53/06 |
| 10,065,094 | B2 * | 9/2018 | Wallin | A63B 53/0466 |
| 10,406,408 | B1 * | 9/2019 | Seluga | A63B 60/00 |
| 10,463,928 | B2 * | 11/2019 | Stokke | A63B 53/04 |
| 11,020,637 | B2 * | 6/2021 | Stokke | A63B 53/06 |
| 11,351,424 | B2 * | 6/2022 | Chen | A63B 53/04 |
| 2008/0146369 | A1 * | 6/2008 | Wahl | A63B 60/02 473/340 |
| 2009/0118034 | A1 * | 5/2009 | Yokota | A63B 53/0466 473/345 |
| 2010/0009774 | A1 * | 1/2010 | Chen | A63B 53/0475 473/350 |
| 2012/0122601 | A1 * | 5/2012 | Beach | A63B 53/02 473/324 |
| 2016/0310809 | A1 * | 10/2016 | Boggs | A63B 53/06 |
| 2018/0056154 | A1 * | 3/2018 | Wallin | A63B 60/02 |
| 2018/0147461 | A1 * | 5/2018 | Stokke | A63B 53/04 |
| 2020/0282273 | A1 * | 9/2020 | Chen | A63B 53/0466 |
| 2022/0184471 | A1 * | 6/2022 | Greaney | A63B 53/0445 |
| 2022/0203184 | A1 * | 6/2022 | Johnson | A63B 53/0433 |
| 2023/0024044 | A1 * | 1/2023 | Cleghorn | A63B 53/0466 |
| 2023/0139568 | A1 * | 5/2023 | Harbert | A63B 53/0433 473/282 |

* cited by examiner

REVERSIBLE SOLE PLATE FOR A GOLF CLUB HEAD

CROSS REFERENCE TO RELATED APPLICATIONS

This application claims priority to U.S. provisional patent application No. 63/245,993 titled "Reversible Sole Plate for a Golf Club Head" and filed on Sep. 20, 2021, the entirety of which is incorporated herein by reference.

REFERENCE REGARDING FEDERALLY SPONSORED RESEARCH OR DEVELOPMENT

Not applicable.

SEQUENCE LISTING

Not applicable.

BACKGROUND

1. Field of the Disclosure

The present disclosure relates to golf clubs, and more specifically to a sole plate for a golf club.

2. Description of the Background of the Disclosure

Different types of golf clubs are used to effect different types of shots, based on a golfer's location and ball lie when playing a hole on a golf course. For example, a golf club may be chosen based on a feature that affects turf interaction of the club. Turf interaction generally refers to the frictional interaction between the golf club and the ground. In most instances, it is desirable to minimize turf interaction, although sometimes increased turf interaction is advantageous. Features to improve turf interaction by reducing friction can include one or more rails or ribs that protrude from the sole and extend longitudinally from the ball-striking surface toward the rear of the club head. In other instances, it may useful to select a golf club with a smooth sole.

SUMMARY

The present disclosure provides a golf club head that includes a body, a face, a first support member, and a sole plate. The sole plate is supported by the first support member and is secured to the body at a perimeter of an opening to an internal cavity of the body. The sole plate is configured to be secured to the body in a plurality of arrangements or configurations.

In some embodiments, a reversible or otherwise customizable sole plate for a golf club head can include a body, a first front rounded corner and a second front rounded corner. The body can define a front portion and a rear portion and can include a first side and a second side. Each of the first side and the second side can include a first fastener recess adjacent to the rear portion, a second fastener recess adjacent to the front portion, and a third fastener recess adjacent to the front portion. The first front rounded corner can be formed by both second fastener recesses and the second front rounded corner can be formed by both the third fastener recesses. The first fastener recess of the first side can be opposite the first fastener recesses of the second side, the second fastener recess of the first side can be opposite the second fastener recess of the second side, and the third fastener recess of the first side can be opposite the third fastener recess of the second side. The sole plate can be configured to be secured to the golf club head in a plurality of orientations or arrangements.

In some embodiments, a reversible sole plate for a golf club head can define a front profile. The front profile can be symmetric about a vertical axis and symmetric about a horizontal axis, the vertical axis and the horizontal axis extending orthogonally to one another.

Some embodiments of the disclosure provide a method of reversing a sole plate of a golf club head. The method can include removing a first fastener from a first fastener recess of a first side of the sole plate. The sole plate can be separated from the golf club head and rotated about a rotation axis defined by the sole plate. The sole plate can be secured to the golf club head via the first fastener. The first fastener can be secured to a first fastener recess of a second side of the sole plate. The first side of the sole plate is opposite the second side of the sole plate.

DETAILED DESCRIPTION OF THE DRAWINGS

The following discussion and accompanying figures disclose various embodiments or configurations of a golf club head with a sole plate to alter the performance characteristics of the club head. More specifically, the following discussion provides a reversible sole plate that allows a player to switch between two different sole surfaces with a single golf club.

Although embodiments are disclosed with reference to a hybrid-type golf club, concepts associated with embodiments of the hybrid-type golf club may be applied to a wide range of golf clubs. For example, embodiments disclosed herein may be applied to a number of golf clubs including wood-type golf clubs, such as a driver, iron-type golf clubs, utility-type golf clubs, and the like. The term "about," as used herein, refers to variation in the numerical quantity that may occur, for example, through typical measuring and manufacturing procedures used for articles of manufacture that may include embodiments of the disclosure herein. Throughout the disclosure, the terms "about" and "approximately" refer to a range of values ±5% of the numeric value that the term precedes.

Figure 1:
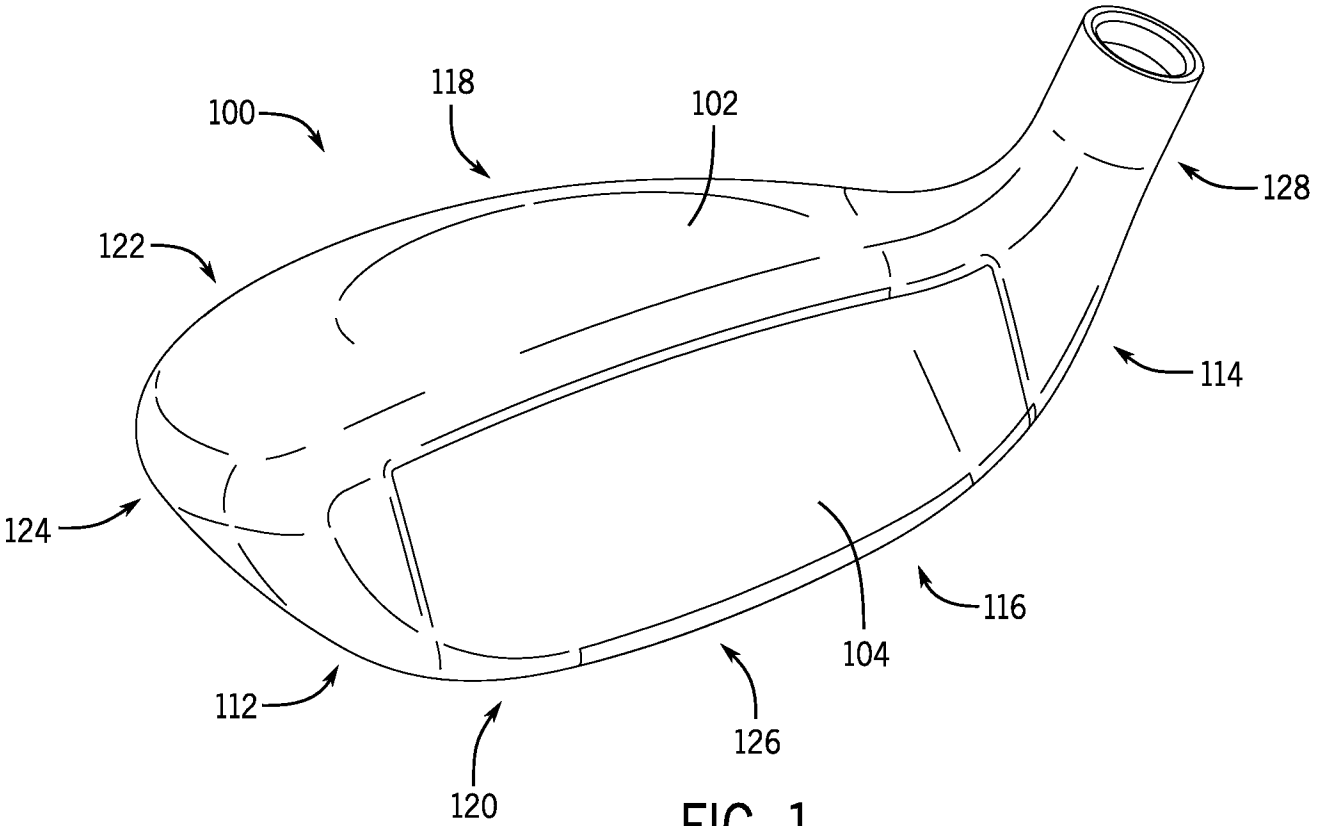
FIG. 1 is a top isometric view of a golf club head according to the present disclosure.

Referring now to FIG. 1, a golf club head 100 is shown in accordance with the present disclosure. The golf club head 100 is generally configured as a hybrid-type golf club head. The golf club head 100 includes a body 102 and a face 104. The golf club head 100 defines a toe side 112, a heel side 114, a front side 116, a top side 118, a bottom side 120, and a rear side 122. The golf club head 100 further includes a toe region 124, a medial region 126, and a heel region 128. The toe region 124 and the heel region 128 are arranged at laterally-opposing ends of the body 102, and the medial region 126 is arranged laterally between the toe region 124 and the heel region 128. The face 104 is at the front side 116 of the body 102 and extends from the toe region 124, through the medial region 126, and to at least a junction between the heel region 128 and the medial region 126. In some embodiments, the face 104 may define a striking face that makes contact with a golf ball.

Figure 2:
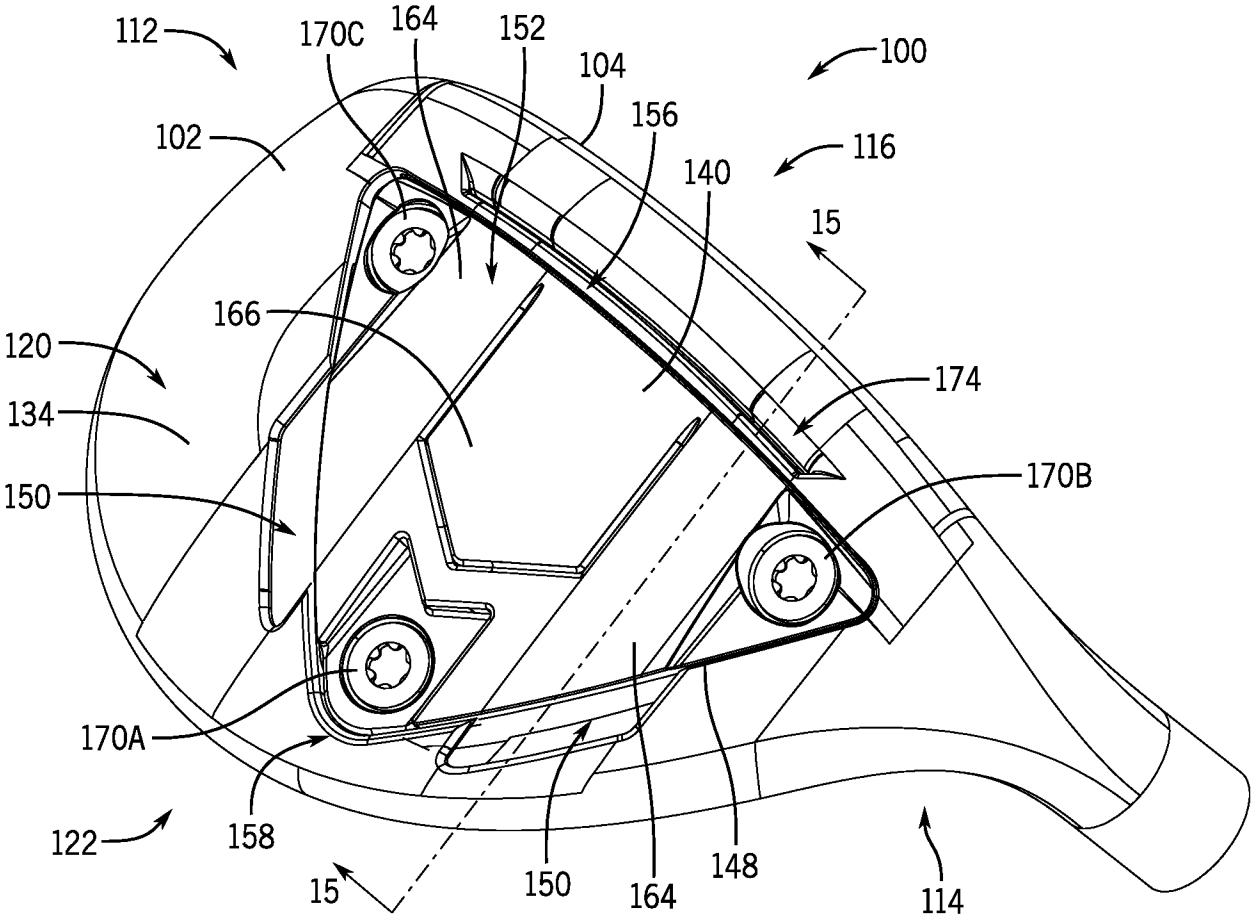
FIG. 2 is a bottom isometric view of the golf club head of FIG. 1 with a sole plate oriented in a first orientation.

FIG. 2 illustrates a bottom view of the golf club head 100 in accordance with the present disclosure. The bottom side 120 of the golf club head 100 includes an exterior surface 134 having a varied curvature across the bottom side 120 of the golf club head 100. The golf club head 100 further includes a sole plate 140 secured to the body 102 at the bottom side 120. The body 102 defines an internal cavity 144 and an opening 146 between the exterior surface 134 of the bottom side 120 of the golf club head 100 and the cavity 144 (see, for example, FIGS. 1, and 7). The opening 146 is bounded by a perimeter 148. The body 102 also includes a pair of recesses 150 formed in the exterior surface 134 of the bottom side 120 of the golf club head 100. The pair of recesses 150 are proximate to the perimeter 148 and oriented toward the rear side 122 of the body 102.

The sole plate 140 can be secured to the body 102 adjacent to the perimeter 148. As illustrated in FIG. 2, the sole plate 140 is secured to the body 102 so that a first side 152 is facing outward at the bottom side 120 of the golf club head 100. Correspondingly, a second side 154 of the sole plate 140 is facing inward toward the cavity 144. The sole plate 140 defines a front portion 156 and a rear portion 158. The front portion 156 faces the front side 116 of the golf club head 100 and the rear portion 158 faces the rear side 122 of the golf club head 100. The orientation of the sole plate 140 shown in FIG. 2 can correspond to a first orientation. In the first orientation, the pair of recesses 150 are aligned and can be generally flush with a corresponding pair of smooth surfaces 164 that are formed in a first surface 166 of the first side 152 of the sole plate 140. The pair of smooth surfaces 164 extend between the front portion 156 and the rear portion 158 of the sole plate 140.

The sole plate 140 can be secured to the body 102 via a fastening system. In the illustrated embodiment, the fastening system includes fasteners 170A-C. A first fastener 170A is disposed near the rear portion 158 of the sole plate 140. Additionally, the first fastener 170A is positioned laterally between the pair of recesses 150 and between the pair of smooth surfaces 164 of the sole plate 140. A second fastener 170B is disposed near the front portion 156 of the sole plate 140 adjacent to the heel side 114 of the golf club head 100, and a third fastener 170C is disposed near the front portion 156 of the sole plate 140 adjacent to the toe side 112 of the golf club head 100. As further illustrated in FIG. 2, the face 104 includes a groove 174 extending between the toe side 112 and the heel side 114 and will be described below with reference to FIGS. 6 and 7.

Figure 3:
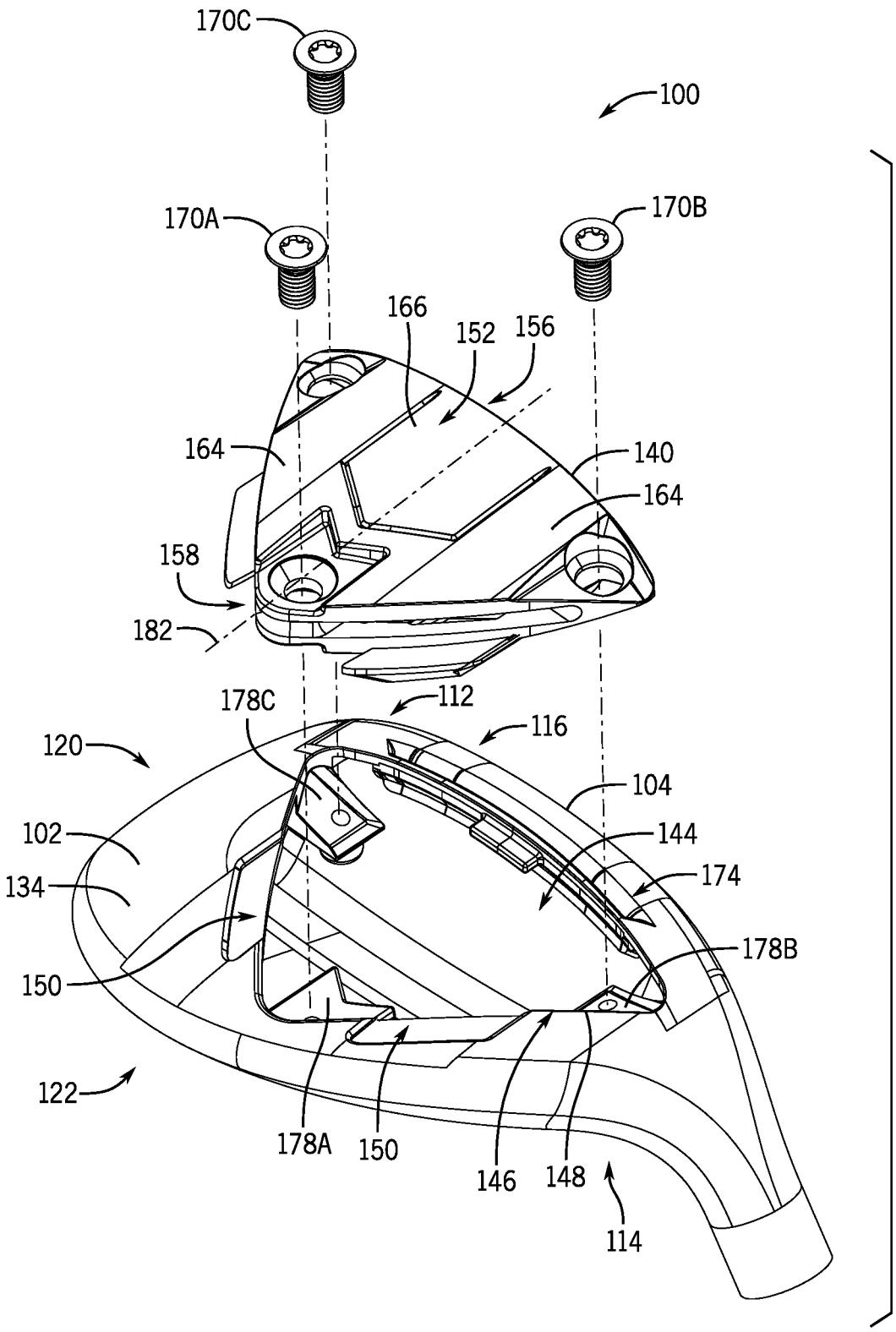
FIG. 3 is an exploded bottom isometric view of the golf club head of FIG. 1.

FIG. 3 illustrates each of the fasteners 170A-C and the sole plate 140 separated from the body 102. In general, the fasteners 170A-C can be removed to separate the sole plate 140 from the body 102. In the illustrated embodiment, the fasteners 170A-C of the fastening system are configured as screws. However, in other embodiments, a fastening system can include one or more of pins, clips, or an interference fit such as a press fit or friction fit, for example, to provide quick connect and disconnect of the sole plate 140 from the body 140. In general, the fasteners 170A-C are each configured to engage a corresponding support member 178A-C of the body 102, which will be described in detail with reference to FIGS. 5 and 6, to secure the sole plate 140 relative to the body 102.

In some embodiments, one or more of the fasteners 170A-C can be configured as weighted fasteners that can be used to customize the center of gravity of the club head 100. For example, the fasteners 170B and 170C may be denser than the fastener 170A so that there is more weight distributed near the front side 116 of the club head 100, and therefore a center of gravity adjusted toward the front side 116 of the club head 100. It should be appreciated that a variety of customized club head weight distributions are possible depending on the user's preference or environmental requirements via interchangeable weighed fasteners 170A-C. The variety of club head weight distributions can correspond to a plurality of customizable arrangements of the club head 100.

With continued reference to FIG. 3, the sole plate 140 defines a rotation axis 182. To move the sole plate 140 from the first orientation to a second orientation (and vice versa), the fasteners 170A-C can be removed from the body 102 and the sole plate 140 can be removed from the bottom side 120 of the body 102. The sole plate 140 can then be rotated (e.g., flipped) 180 degrees about the rotation axis 182. After the sole plate 140 has been flipped, the sole plate 140 can be reinstalled at the perimeter 148 of the opening 146 in the second orientation.

Figure 4:
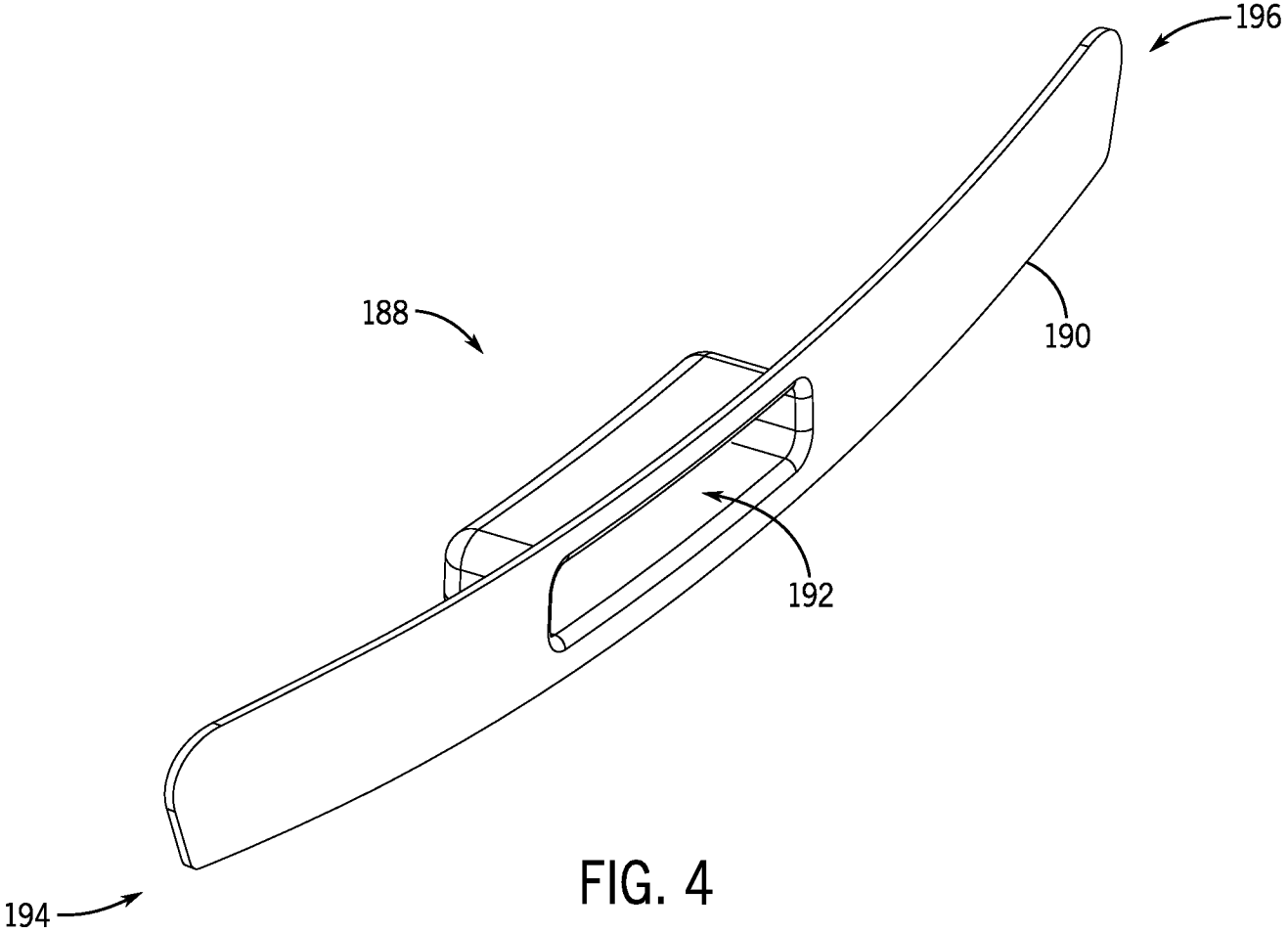
FIG. 4 is an isometric view of a seal for the golf club head of FIG. 1 according to an embodiment of the present disclosure.

Further, in some embodiments, the golf club head 100 can include a gasket or seal seated between the sole plate 140 (e.g., at the perimeter 148) and the body 102 when the sole plate 140 is secured to the body 102. The gasket can extend along a perimeter of the cavity 144 in the club head 100 to provide a seal between the club head 100 and the sole plate 140. Additionally or alternatively, a seal can be provided at individual portions of the sole plate, including at one or more of the front portion 156 and the rear portion 158. For example, with reference to FIG. 4, a seal 188, which may be configured as a gasket, cap, or other barrier can surround a portion of the body 102 and/or sole plate 140 and provide an interface between the front portion 156 of the sole plate 140 and the perimeter 148 of the opening 146 to the cavity 144 in the club head 100.

In the illustrated embodiment, the seal 188 can define a seal body 190 that can extend between a toe end 194 and a heel end 196 of the body 102. The seal body 190 can include a cavity 192 dimensioned to receive the support member (e.g., support member 214) of the body 102 therein. The cavity 192 of the seal body 190 can both provide an alignment feature to align the seal 188 with each of the golf club head 100 and the sole plate 140, and provide a seal or barrier around one or more contact points between the golf club head 100 and the sole plate 140. In some embodiments, the seal 188 can comprise a rubber or other polymer material that can prevent water or other debris from entering the cavity 144 in the club head 100 when the sole plate 140 is in a secured orientation.

Figure 5:
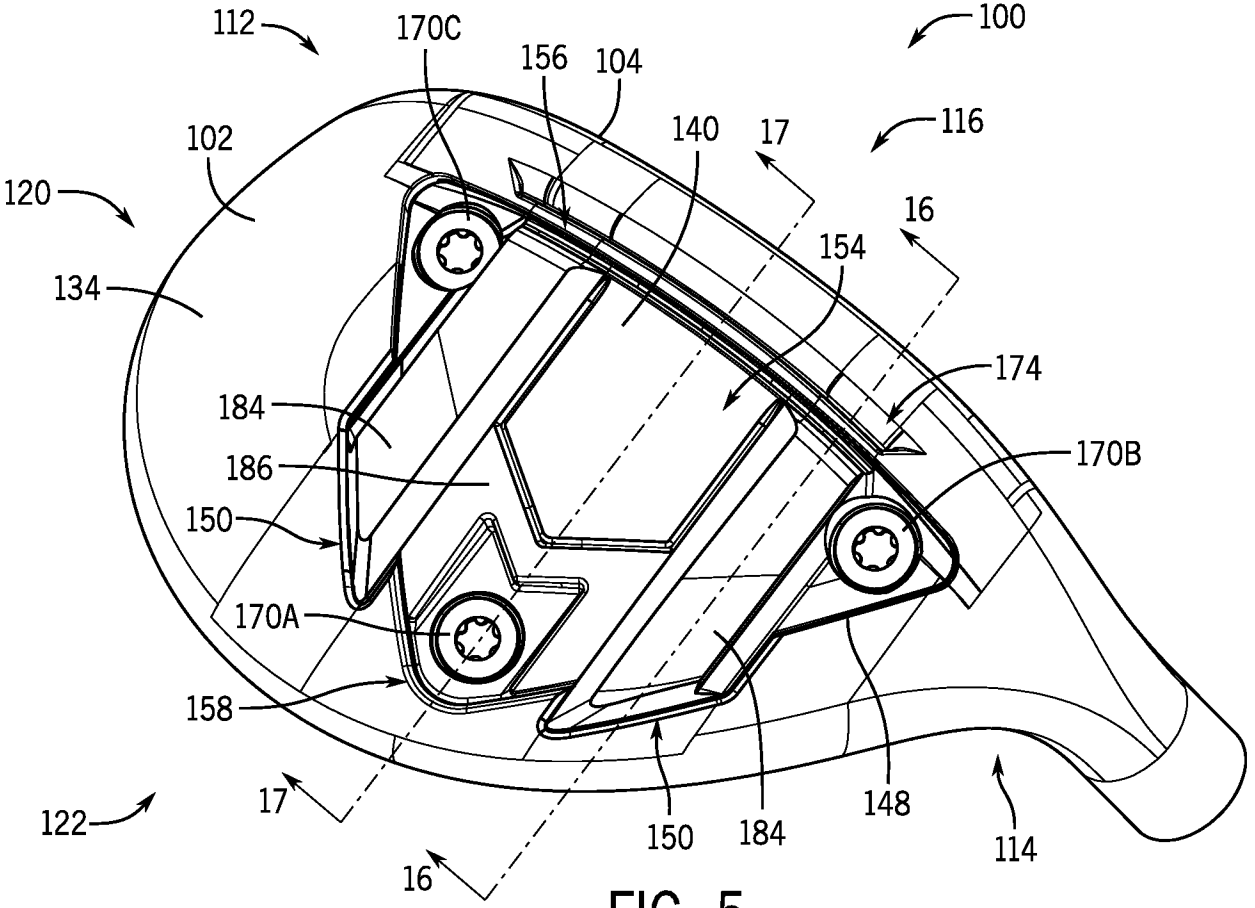
FIG. 5 is a bottom isometric view of the golf club head of FIG. 1 with the sole plate oriented in a second orientation.

FIG. 5 illustrates the sole plate 140 secured to the body 102 in the second orientation. In the second orientation, the second side 154 of the sole plate 140 is facing outward at the bottom side 120 of the golf club head 100. Correspondingly, the first side 152 of the sole plate 140 is facing inward toward the cavity 144. The second side 154 of the sole plate 140 includes a pair of rails 184 that extend from a second surface 186 of the second side 154 of the sole plate 140. The pair of rails 184 generally extend between the front portion 156 and the rear portion 158 of the sole plate 140. When the sole plate 140 is secured to the body 102 in the second orientation, the pair of rails 184 extend across the perimeter 148 of the opening 146 and into the pair of recesses 150 of the exterior surface 134 of the body 102.

In general, the reversibility of the sole plate 140 provides a single golf club head 100 with a single sole plate 140, the single sole plate 140 providing two separate sole configurations having multiple turf-engaging features integrally formed with the sole plate 140 without requiring supplemental turf-engaging elements to be secured or otherwise affixed to the golf club head 100. In particular, the first side 152 of the sole plate 140, when the sole plate 140 is secured to the body 102 in the first orientation, provides a smooth sole surface. The second side 154 of the sole plate 140, when the sole plate 140 is secured to the body 102 in the second orientation, provides a pair of rails 184 that protrude from the bottom side 120 of the golf club head 100. As discussed above, rails can reduce friction between a golf club head and the ground to improve turf interaction. In general, rails can provide more ground forgiveness and can assist the gliding exit of the club head from the turf.

Figure 6:
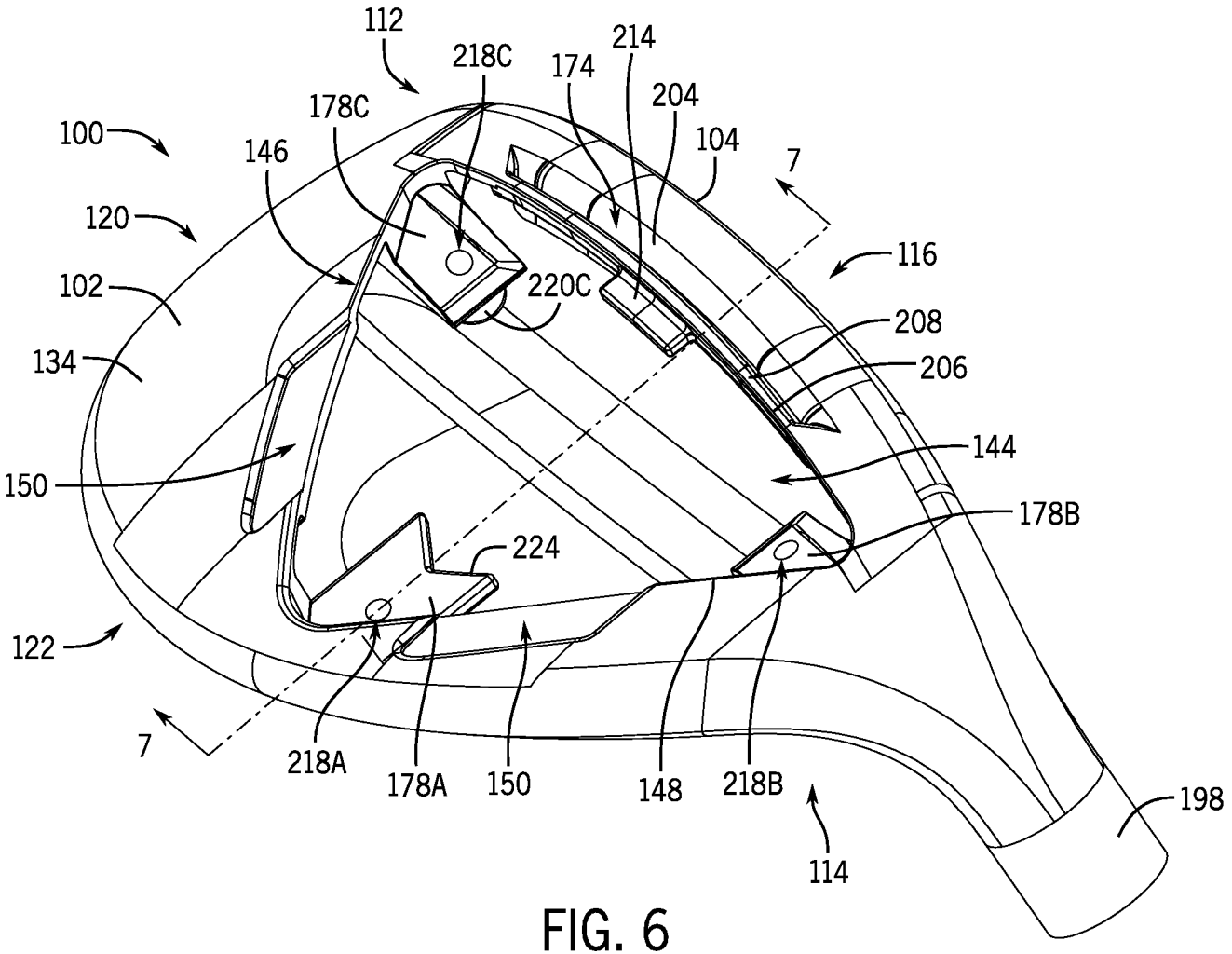
FIG. 6 is a bottom isometric view of a body of the golf club head of FIG. 1 with the sole plate removed.
Figure 7:
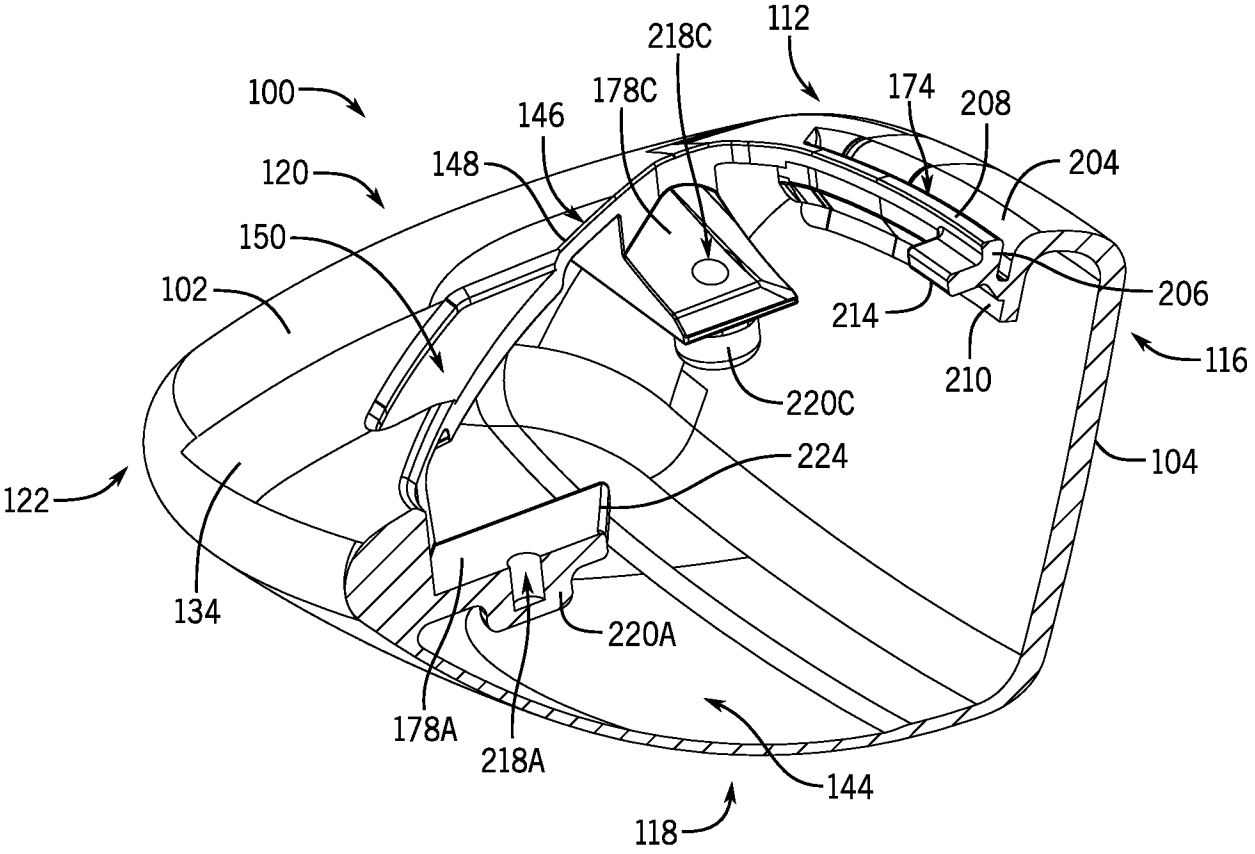
FIG. 7 is a cross-sectional view of the body of the golf club head of FIG. 1 taken along line 6-6 of FIG. 6.

Referring now to FIGS. 6 and 7, the body 102 may be formed as a unitary component (e.g., a single piece of material) via a variety of manufacturing methods, such as casting and printing, for example. The body 102 defines the cavity 144 and further includes a hosel 198. The hosel 198 is arranged within the heel region 128 of the body 102 and extends from the heel region 128 at an angle (e.g., a lie angle formed between a plane parallel to the ground on which the club head rests at address and a center axis defined through the hosel 198 in a direction away from the toe region 124. The internal cavity 144 defines a hollow volume and is accessible via the opening 146 surrounded by the perimeter 148. As briefly discussed above, the exterior surface 134 of the body 102 at the bottom side 120 of the golf club head 100 defines a varied curvature, which is generally coplanar (e.g., within a curved plane) and preserved by the perimeter 148 so that the perimeter 148 remains generally flush with the exterior surface 134.

The groove 174 that extends between the toe side 112 and the heel side 114 of the face 104 is defined by a front wall 204 and a back wall 206, the back wall 206 having a ground facing surface 208. The groove 174 is integrally formed with the face 104 and includes a cross section having a lower flange 210 extending below the groove 174 (see, for example, FIG. 7). Also shown in FIG. 7, the lower flange 210 forms a J-shape with the front of the face 104. In general, the distance between the front wall 204 and the back wall 206 provides a width of the groove 174. The width of the groove 174 contributes to the flexibility of the face 104 and can allow the face to flex during an impact with a golf ball. The groove 174 also helps maintain a thinness of the face 104 and body 102 once the face 104 is secured (e.g., welded) to the body 102 while providing sufficient rigidity to secure the sole plate 140. Generally, a thinner face and body can correspond to increased distance and club forgiveness.

Still referring to FIGS. 6 and 7, the back wall 206 of the groove 174 includes a front support member 214 outside the groove 174 and extending from the back wall 206 toward the rear side 122 of the golf club head 100. In the illustrated embodiment, the front support member 214 is generally configured as a tab near the medial region 126. However, in other embodiments, the tab can be disposed closer toward the toe side 112 or the heel side 114. In other embodiments, a body of a golf club head can include a plurality of front support members, or a front support member extending between the toe side 112 and the heel side 114 (see, for example, FIG. 18). In general, the front support member 214 provides a shoulder to align and support the sole plate 140.

Each of the front support member 214 and the support members 178A-C are recessed into the cavity 144 relative to the perimeter 148. The support members 178A-C each include a respective fastener hole 218A-C that extend through a respective nut portion 220A-C of the support members 178A-C. The respective nut portions 220A-C extend from the support members 178A-C toward the top side 118 of the golf club head 100. The first support member 178A extends from the body 102 toward the front side 116 of the golf club head 100. The first support member 178A includes a distal perimeter 224. In the illustrated embodiment, the distal perimeter 224 has a generally V-shaped profile; however, other profile geometries are possible. The second support member 178B extends from the body 102 toward the toe side 112 of the golf club head 100. The third support member 178C, configured substantially similar to the second support member 178B, extends from the body 102 toward the heel side 114 of the golf club head 100.

Figure 8:
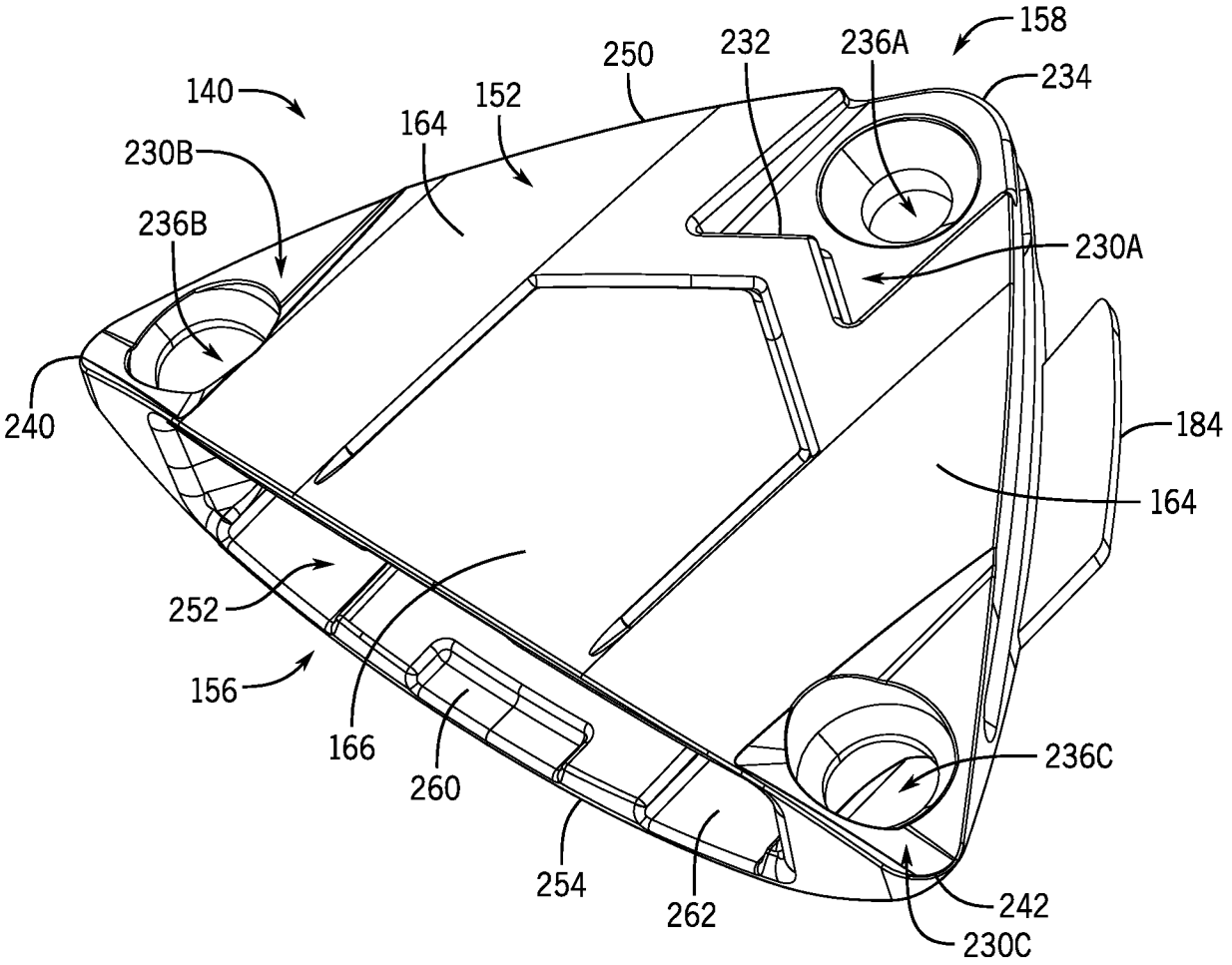
FIG. 8 is front isometric view of a first side of the sole plate of FIG. 2.
Figure 9:
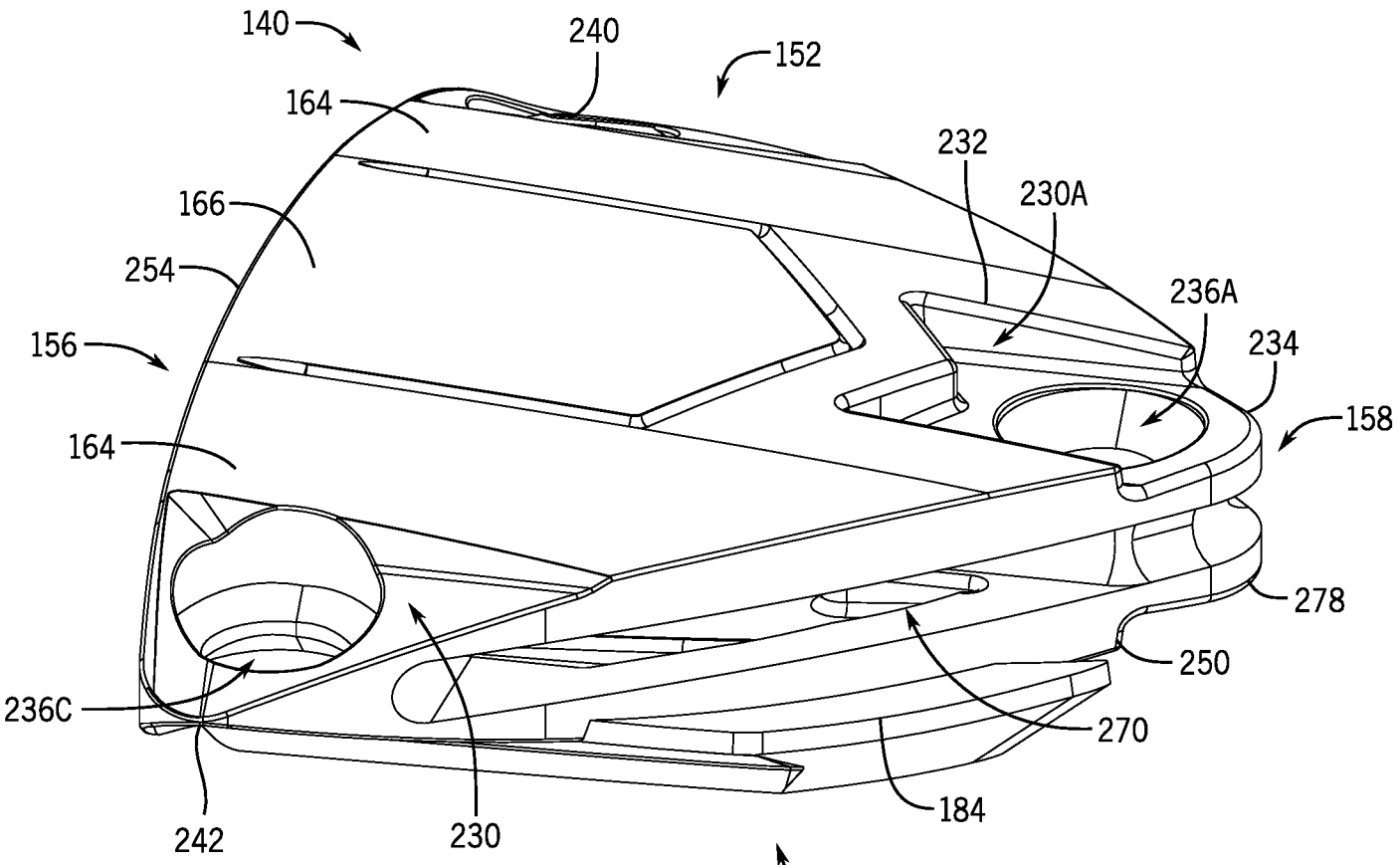
FIG. 9 is a rear isometric view of the first side of the sole plate of FIG. 2.

FIGS. 8-14 illustrate the sole plate 140 in accordance with the present disclosure. With reference to FIGS. 8 and 9, the first side 152 of the sole plate 140 includes the first surface 166. The pair of smooth surfaces 164 extend across the first surface 166 in a generally parallel direction. The first side 152 also includes a first fastener recess 230A adjacent to the rear portion 158 of the sole plate 140. The first fastener recess 230A is recessed relative to the first surface 166 and includes a perimeter 232 surrounding the first fastener recess 230A. In the illustrated embodiment, the perimeter 232 has a generally V-shaped profile that corresponds to the geometry of the distal perimeter 224 of the first support member 178A so that the first support member 178A can be seated in and aligned with the first fastener recess 230A of the first side 152 when the sole plate 140 is in the second orientation.

The first fastener recess 230A at least partially defines a rear rounded corner 234 at the rear portion 158 of the sole plate 140. The first fastener recess 230A also includes a first through hole 236A. The first through hole 236A includes a countersunk opening at the first fastener recess 230A that is configured to receive a head of the first fastener 170A therein. In the illustrated embodiment, the first side 152 of the sole plate 140 also includes second and third fastener recesses 230B, 230C adjacent to the front portion 156 of the sole plate 140. Each of the fastener recesses 230A-C are spaced apart and separated by the first surface 166. The second fastener recess 230B at least partially defines a front rounded corner 240 and includes a second through hole 236B. Similar to the first through hole 236A, the second through hole 236B includes a countersunk opening that is configured to receive a head of the second fastener 170B therein.

Similar to the second fastener recess 230B, the third fastener recess 230C at least partially defines a front rounded corner 242 and includes a third through hole 236C. The third through hole 236C includes a countersunk opening that is configured to receive a head of the third fastener 170C therein. In some embodiments, each of the through holes 236A-C can include internal threads that are configured to engage external threads of the corresponding fasteners 170A-C. Additionally, as illustrated in FIG. 9, for example, the front rounded corner 242 proximate to the third fastener recess 230C is configured as a hyperbolic edge (e.g., edges adjacent to the front rounded corner 242 include a geometric profile resembling a hyperbola when mapped two-dimensionally). Similarly, the front rounded corner 240 proximate to the second fastener recess 230B is configured as a hyperbolic edge (see, for example, FIG. 10).

As illustrated in FIGS. 8-11, the sole plate 140 generally forms a hollow body 250. The hollow body 250 includes an opening 252 at the front portion 156 of the sole plate 140. When viewed from a front view (see, for example, FIGS. 12 and 13), the opening 252 is surrounded by a front perimeter 254. The front perimeter 254 extends around the first side 152 and the second side 154 of the sole plate 140 as a continuous boundary. As illustrated in FIG. 8, a front support interface 260 is formed adjacent to the front perimeter 254 in the opening 252. The front support interface 260 is formed in an internal surface 262 of the sole plate 140 opposite the second surface 186.

Similar to the front support interface 260, a front support interface 264 is formed adjacent to the front perimeter 254 in the opening 252 and opposite the opening 252 from the front support interface 260. The front support interface 264 is formed in an internal surface 266 of the sole plate 140 opposite the first surface 166 (see, for example, FIG. 10). Each of the front support interfaces 260, 264 are configured as a recess and are dimensioned to engage the front support member 214 of the body 102. In particular, the front support interface 264 engages the front support member 214 when the sole plate 140 is secured to the body 102 in the first orientation and the support interface 260 engages the front support member 214 when the sole plate 140 is secured to the body 102 in the second orientation.

Further illustrated in FIGS. 8-11, the hollow body 250 of the sole plate 140 includes a channel 270 that extends from the front portion 156 of the sole plate 140 near the front rounded corner 240, around the rear portion 158 of the sole plate 140, and toward the front portion of the sole plate 140 near the rounded corner 242. The channel 270 provides an opening within the hollow body 250 between one front rounded corner 240 and the rear rounded corner 234, between the other front rounded corner 240 and the rear rounded corner 234, and between the first side 152 of the sole plate 140 and the second side 154 of the sole plate 140. In some embodiments, the hollow body 250 can include internal structures or features that can provide an adjustable weighting system. For example, the hollow body 250 may be able to selectively receive weights secured therein or thereto. In some embodiments, the selectively received weights can be secured to one or more of the first side 152 and the second side 154 of the sole plate 140 to provide a desirable club head weighting.

Figure 10:
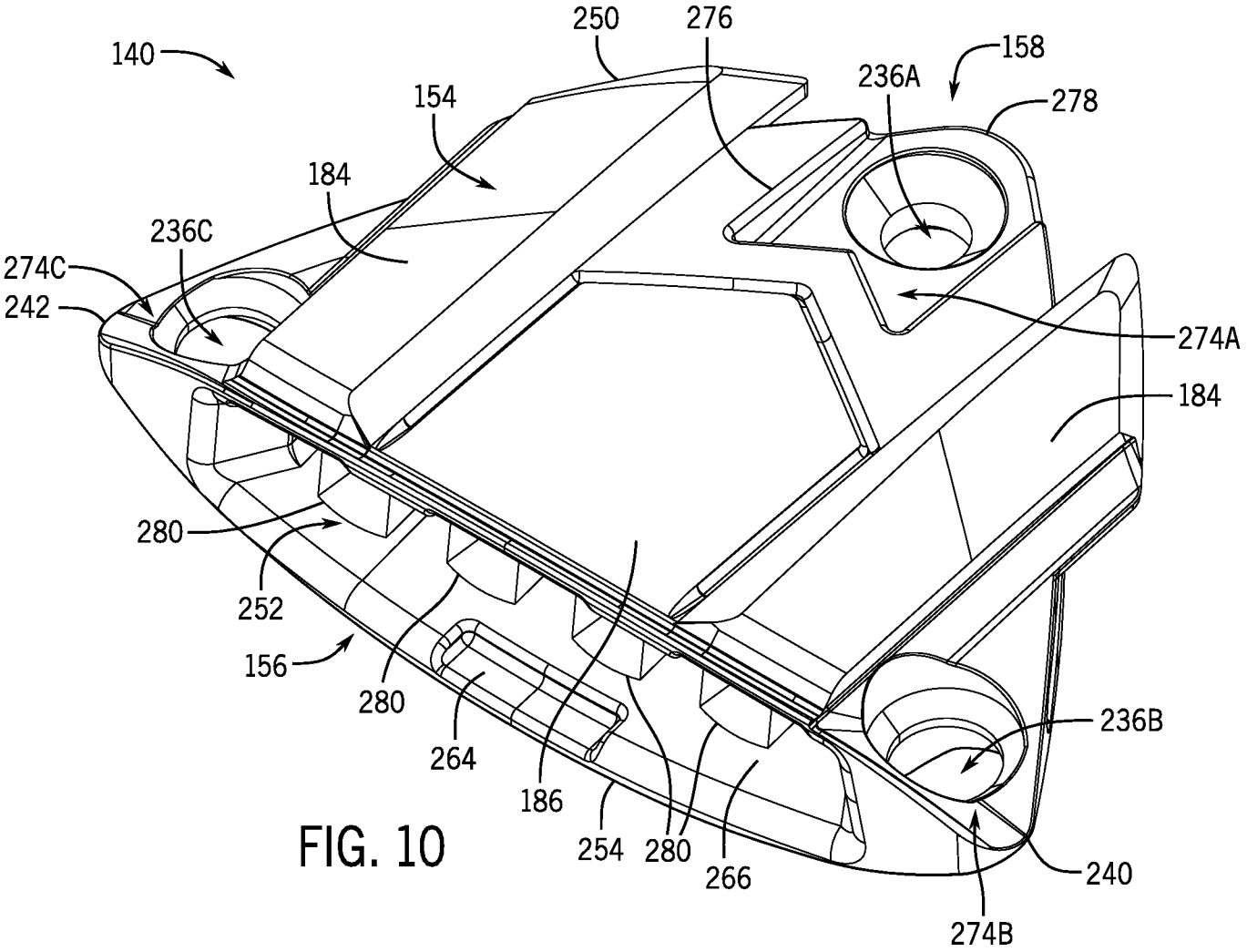
FIG. 10 is a front isometric view of a second side of the sole plate of FIG. 2.

With continued reference to FIG. 10, in some embodiments, the sole plate 140 can include weight retainers 280 formed in the hollow body 250 of the sole plate 140. The weight retainers 280 can provide a recess or anchor structure to which a variety of weights (e.g., removeable weights) can be interchanged and secured relative to the sole plate 140. The weight retainers 280 can allow a user to customize the weight and balance of the sole plate 140, and thus the golf club head 100. In the illustrated embodiment, a plurality of weight retainers 280 extend laterally across the hollow body 250 of the sole plate 140 so that a customizable distribution of weights can be inserted between the toe and heel regions of the sole plate 140. However, in other embodiments, the more or fewer weight retainers 280 can be dispersed within the hollow body 250 of the sole plate 140 to provide custom weights and weight arrangements that can be used to adjust the center of gravity of the golf club head 100.

In some embodiments, the weight retainers 280 can provide a pocket structure so that individual weights can be quickly inserted or removed from one or more of the weight retainers 280 depending on a user's preference and environmental factors. For example, it may be generally useful to adjust the club head center of gravity based on a variety of course conditions and player preference of club balance.

In general, a weight configuration accommodated by the weight retainers 280 can be modified to increase the weight of the club head 100, decrease the weight of the club head 100, or translate the center of gravity of the club head. For example, external weights may be provided in one or more of a top portion, a bottom portion, a distal side, or a proximal side of the sole plate 140 and secured relative to the sole plate 140 via the weight retainers 280. In some embodiments, the weights can be inserted into the hollow body 250 of the sole plate 140 from the front portion 156, and similarly removed from the hollow body 250 from the front portion 156.

In use, one or more weights can be received by the weigh retainer 280 to adjust the weighting of the club head 100. The weights can be secured within the weight retainer 280 via a variety of methods, including one or more of snap fit, interference fit, magnetic connection, adhesives, or retention pins. In some embodiments, a set of weights may be used to selectively adjust the weighting of the club head 100 and one or more weights are configured to be received in one or more weight retainers 280. In some embodiments, the weights received by the weight retainers 280 may be finely adjustable via a modular design or other additive modifications. For example, in some embodiments, a weighted (e.g., lead) tape may be used to customize an individual mass of a weight that may be received by one or more of the weight retainers 280. Additionally or alternatively, a plurality of magnets may be connected together to incrementally adjust the weighting of the club head 100.

As briefly described above, one or more weighted screws can be used to customize the weight and center of gravity of the club head 100. In use, the weighted screws can work in conjunction with the weights received by the weight retainers 280 to further customize the weight of the sole plate 140, and thus the club head 100. For example, in use, one or more screws 170A-C can be removed from the sole plate 140, the sole plate 140 can be removed from the head 100. The sole plate 140 can then be equipped with an intentional weight configuration received by the weight retainers 280. The sole plate 140 can then be secured to the club head 100 via the fasteners 170A-C, which can be weighted depending on course conditions and user preference.

In the illustrated embodiment, the weight retainers 280 can include structures integrally formed with the sole plate 140 within the hollow body 250. However, in other embodiments, the weight retainers 280 may be insertable into the hollow body 250. Additionally, in some embodiments, the weight retainers 280 can include one or more detents formed on or within the hollow body 250 that weights can be snapped to or generally aligned with. For example, the weight retainers 280 can generally be detents, grooves, or other structures that provide a rigid alignment of insertable weights, such as magnetic weights, that can be deliberately added or removed depending on a user's preference.

Figure 11:
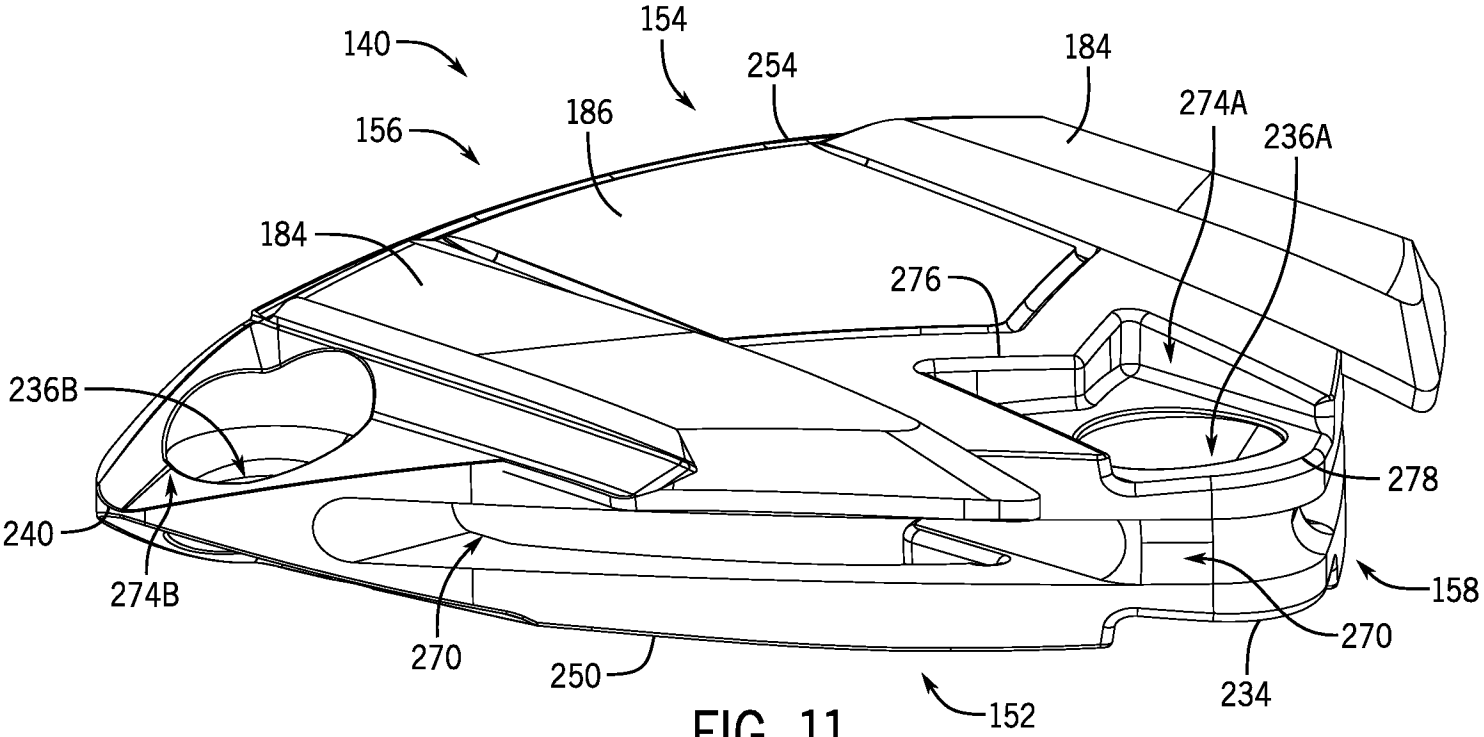
FIG. 11 is a rear isometric view of the second side of the sole plate of FIG. 2.

With continued reference to FIGS. 10 and 11, the second side 154 of the sole plate 140 includes the second surface 186. The pair of rails 184 extend across the second surface 186 in a generally parallel direction. The second side 154 also includes a first fastener recess 274A opposite the first fastener recess 230A of the first side 152 and adjacent to the rear portion 158 of the sole plate 140. Like the first fastener recess 230A, the first fastener recess 274A of the second side 154 includes a perimeter 276 that surrounds the first fastener recess 274A. In the illustrated embodiment, the perimeter 276 has a generally V-shaped profile that corresponds to the geometry of the distal perimeter 224 of the first support member 178A so that the first support member 178A can be seated in and aligned with the first fastener recess 274A of the second side 154 when the sole plate 140 is in the first orientation.

The first fastener recess 274A at least partially defines a rear rounded corner 278 at the rear portion 158 of the sole plate 140. The rear rounded corner 278 of the second side 154 is opposite the channel 270 and separated (e.g., vertically) from the rear rounded corner 234 of the first side 152. The first through hole 236A extends between the first fastener recess 274A of the second side 154 to the first fastener recess 230A of the first side 152 and similarly includes a countersunk opening at the second side 154. In the illustrated embodiment, the second side 154 of the sole plate 140 also includes second and third fastener recess 274B, 274C adjacent to the front portion 156 of the sole plate 140 and opposite the corresponding second and third fastener recesses 230B, 230C of the first side 152.

The second fastener recess 274B at least partially defines the front rounded corner 240 in conjunction with the second fastener recess 230B of the first side 152. The second through hole 236B extends between the second fastener recess 274B of the second side 154 to the second fastener recess 230B of the first side 152 and similarly includes a countersunk opening at the second side 154. The third fastener recess 274C at least partially defines the front rounded corner 242 in conjunction with the third fastener recess 230C of the first side 152. Correspondingly, the third through hole 236C extends between the third fastener recess 274C of the second side 154 to the third fastener recess 230C of the first side 152 and similarly includes a countersunk opening at the second side 154.

As further illustrated in FIGS. 10 and 11, the pair of rails 184 each extend in a lateral direction from the front portion 156 of the sole plate 140, proximate to the respective second and third fastener recesses 274B, 274C, toward the rear portion 158 of the sole plate 140. Adjacent to the rear portion 158 of the sole plate 140, the pair of rails 184 extend laterally beyond the hollow body 250 of the sole plate 140. The pair of rails 184 also extend in a generally vertical direction from the second surface 186 of the sole plate 140 to define a rail height $h_r$ (see, for example, FIG. 14).

Figure 12:
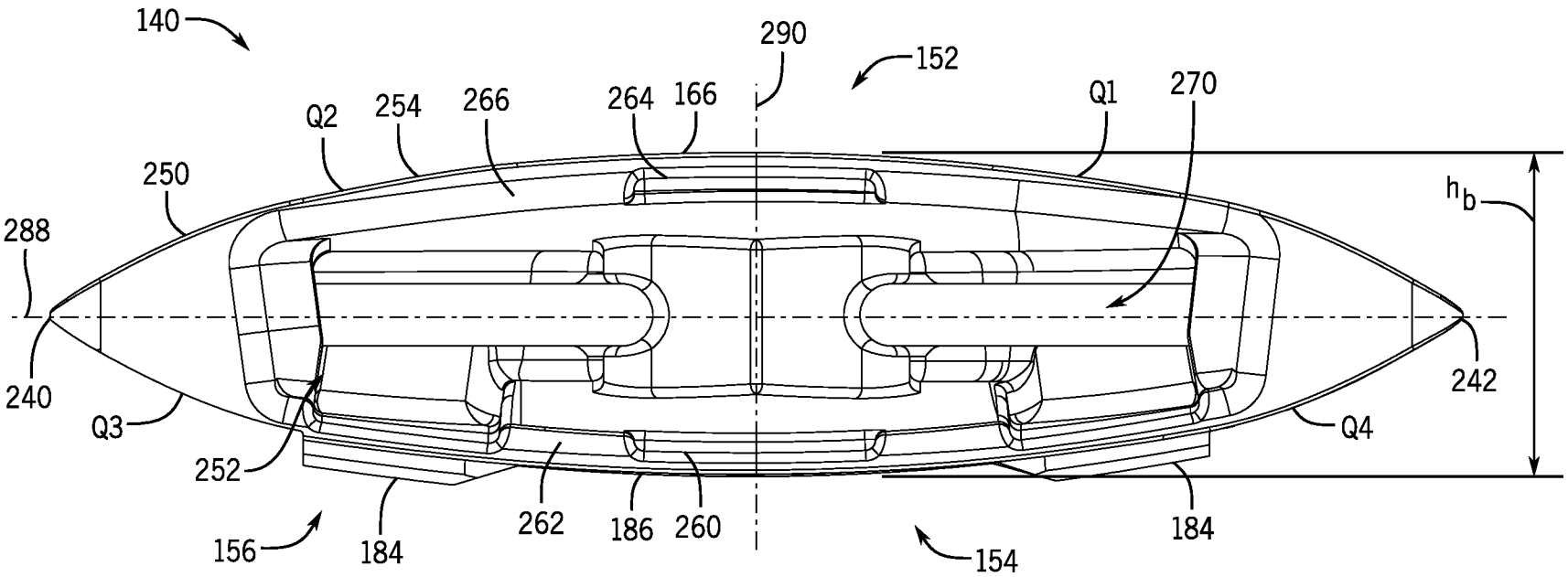
FIG. 12 is a front elevation view of the sole plate of FIG. 2.

FIG. 12 illustrates a front view of the sole plate 140 with a horizontal centerline 288 and a vertical centerline 290. The horizontal centerline 288 intersects each of the front rounded corners 240, 242 and extends across the opening 252 in the front portion 156 of the sole plate 140. The vertical centerline 290 extends perpendicular to the horizontal centerline 288 and intersects the front perimeter 254 at each of the first surface 166 on the first side 152 of the sole plate 140 and the second surface 186 on the second side 154 of the sole plate 140. The vertical centerline 290 intersects the front perimeter 254 at the first side 152 and the second side 154 to define a body height $h_b$ of the sole plate 140. When the sole plate 140 is secured to the body 102, the sole plate 140 extends into the cavity 144 a distance equal to the body height $h_b$.

Further illustrated in FIG. 12, the horizontal centerline 288 and the vertical centerline 290 divide the front perimeter 254 of the sole plate 140 into four segments Q1-Q4. The segments Q3 and Q4 do not include the profile of the pair of rails 184 so that the segments Q3 and Q4 maintain a continuous, non-stepped curve. In the illustrated embodiment, the varied radius of curvature (e.g., the 2-D profile) for each of the segments Q1-Q4 are the same if translated across a mirror line so that the front perimeter 254 is symmetric about two axes. For example, the segment Q1 could be mirrored across vertical centerline 290 to form the segment Q2 and the segment Q2 could be mirrored across the horizontal centerline 288 to form the segment Q3, and so on. In other embodiments, the varied radius of curvature of the segments Q1-Q4 may only be similar in a diagonal direction. For example, the segment Q1 and the segment Q3, which are diagonally opposite each other, are geometrically similar such that the profile of the segment Q1 could be mirrored across the horizontal centerline 288 and then across the vertical centerline 290 (or in reverse order) to form the same profile of the segment Q3.

Figure 13:
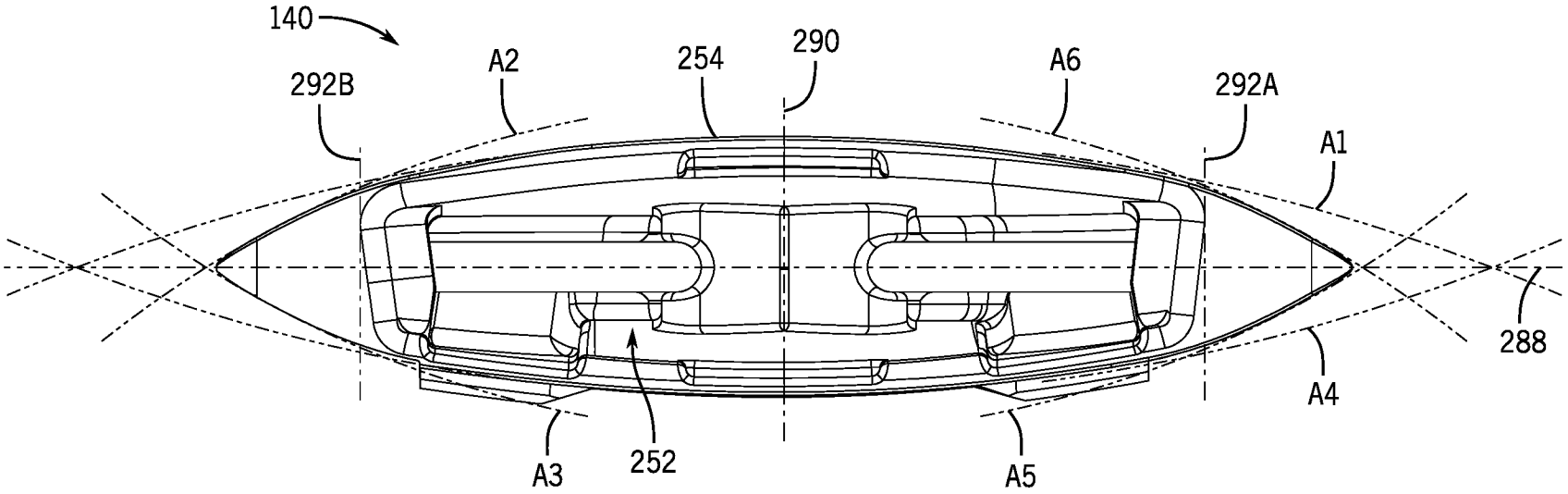
FIG. 13 is a front elevation view of the sole plate of FIG. 2 showing relative radii of curvatures of a front perimeter of the sole plate.

FIG. 13 illustrates the front view of the sole plate 140 with arcs A1-A6 that correspond to a radius of curvature of portions of the segments Q1-Q4 shown in FIG. 12. Also illustrated are inflection axes 292A, 292B that intersect the front perimeter 254 at four corresponding points of inflection where the local radius of curvature of the front perimeter 254 changes. The arc A1 represents the radius of curvature of the segment of the front perimeter 254 that extends from the first inflection axis 292A to the second inflection axis 292B at the first side 152 of the sole plate 140. The arc A2 represents the radius of curvature of the segment of the front perimeter 254 that extends from the second inflection axis 292B to the horizontal centerline 288 at the first side 152. The arc A3 represents the radius of curvature of the segment of the front perimeter 254 that extends from the horizontal centerline 288 to the second inflection axis 292B at the second side 154 of the sole plate 140. The arc A4 represents the radius of curvature of the segment of the front perimeter 254 that extends from the second inflection axis 292B to the first inflection axis 292A at the second side 154. The arc A5 represents the radius of curvature of the segment of the front perimeter 254 that extends from the first inflection axis 292A to the horizontal centerline 288 at the second side 154. The arc A6 represents the radius of curvature of the segment of the front perimeter 254 that extends from the horizontal centerline 288 to the first inflection axis 292A at the first side 152.

In the illustrated embodiment, each radius of curvature of the arcs A2, A3, A5, and A6 are equal. Likewise, each radius of curvature of the arcs A1 and A4 are equal. In the illustrated embodiment, the segment of the front perimeter 254 that intersects the horizontal centerline 288 at the first side 152 is a mirrored profile (across the centerline 288) of the segment of the front perimeter 254 that intersects the horizontal centerline 288 at the second side 154. However, in some embodiments, the front perimeter 254 may not be symmetric about the horizontal centerline 288 so that, for example, the only equal pairs of radii of curvatures might include arc A1 equal to arc A4; arc A2 equal to arc A5; and arc A3 equal to arc A6.

Figure 14:
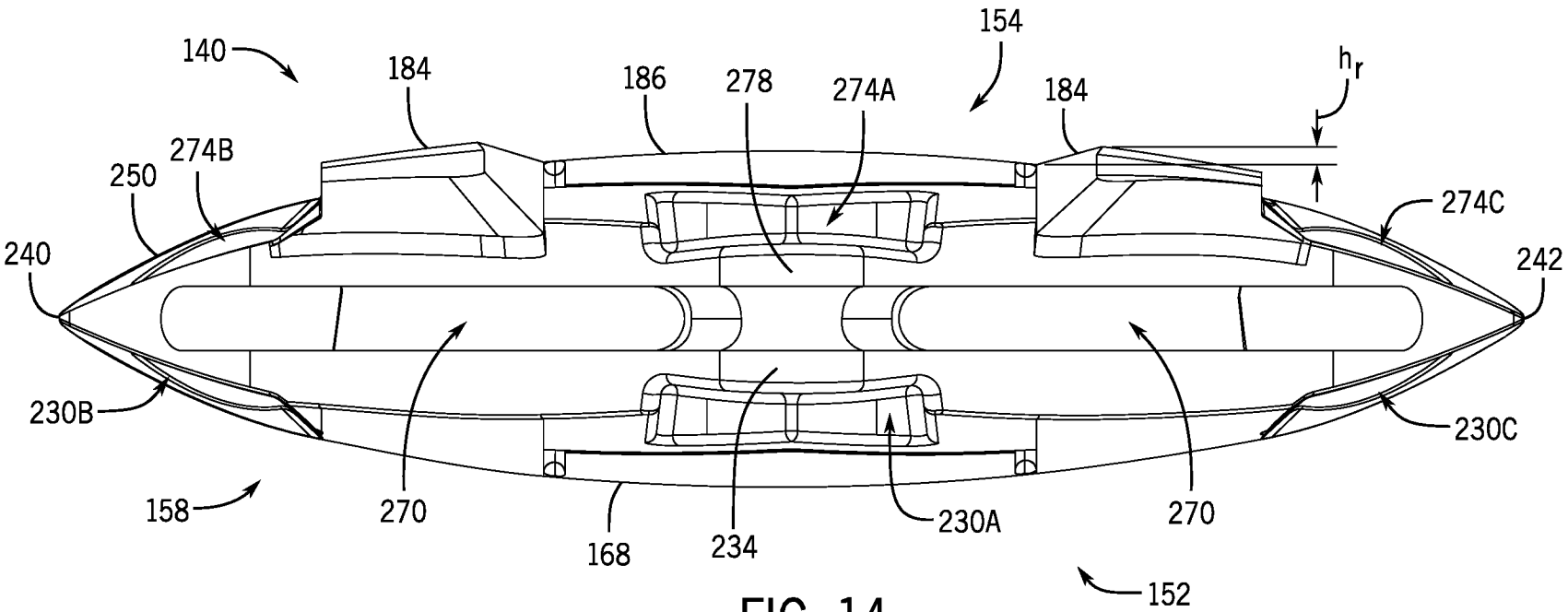
FIG. 14 is a rear elevation view of the sole plate of FIG. 2.

Referring now to FIG. 14, as briefly described above, the pair of rails 184 extend in a vertical direction from the second surface 186 on the second side 154 of the sole plate 140 to define the rail height $h_r$. In general, the rail height $h_r$ corresponds to a maximum distance that each of the pair of rails 184 extend beyond (e.g., in a vertical direction) from the second surface 186. Further illustrated in FIG. 14, as briefly described above, the channel 270 provides an opening within the hollow body 250 of the sole plate 140 and spaces apart (e.g., vertically) the rear rounded corner 234 of the first side 152 of the sole plate 140 and the rear rounded corner 278 of the second side 154 of the sole plate 140.

Figure 15:
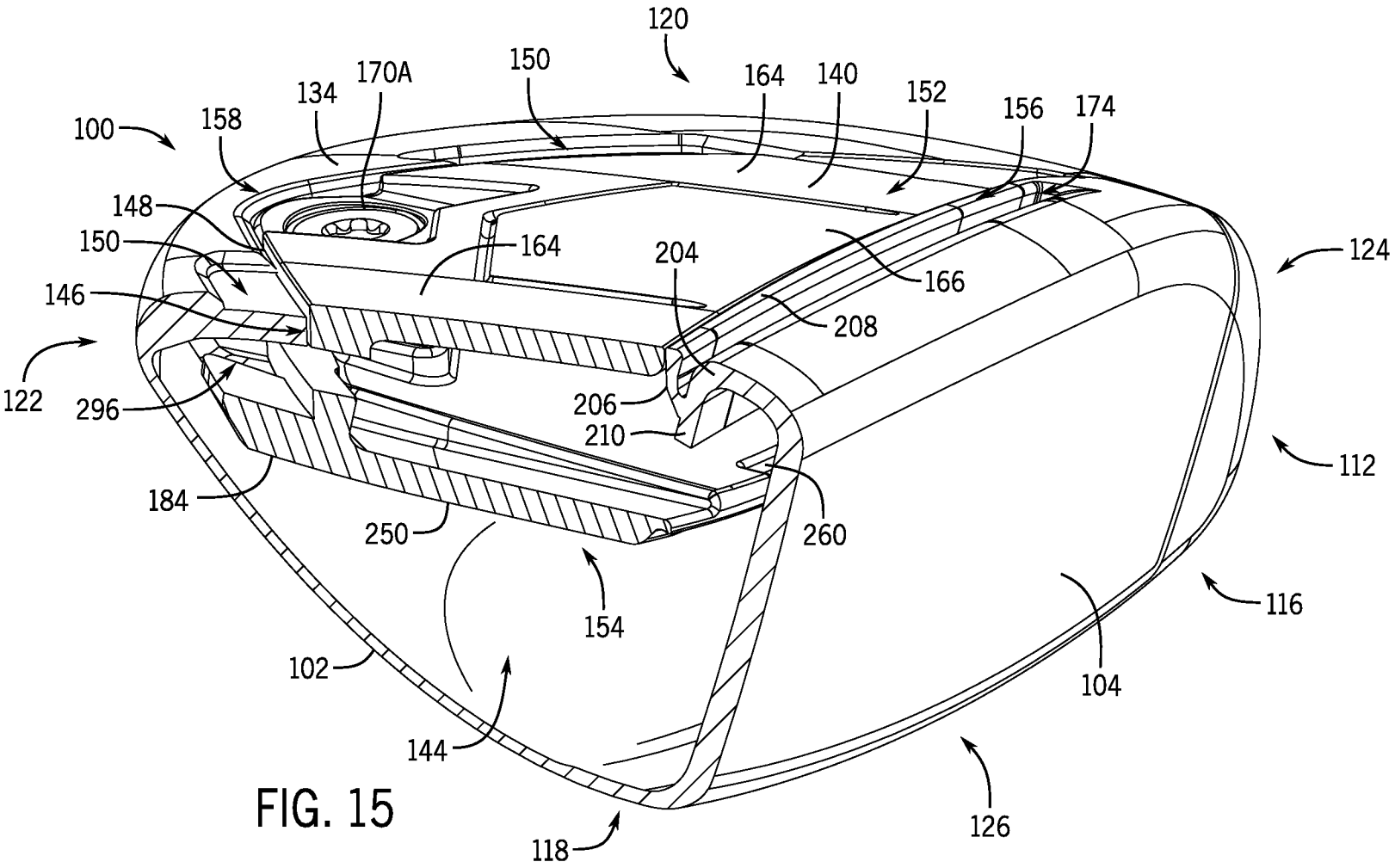
FIG. 15 is a cross-sectional view of the golf club head assembled with the sole plate in the first orientation taken along line 14-14 of FIG. 2.

FIG. 15 illustrates the sole plate 140 secured to the body 102 in the first orientation. In the first orientation, the first side 152 of the sole plate 140 faces outward at the bottom side 120 of the golf club head 100. The sole plate 140 is secured to the body 102 so that the pair of smooth surfaces 164 are aligned with the pair of recesses 150 in the bottom side 120 of the golf club head 100. Opposite the exterior surface 134 of the body 102, the pair of rails 184 extend within the cavity 144 below (relative to FIG. 15) and spaced apart from the opening 146 in the body 102. The pair of rails 184 extend within the cavity 144 to form a gap 296 between an underside of the pair of rails 184 and the body 102.

Further illustrated in FIG. 15, the front portion 156 of the sole plate 140 is adjacent to the back wall 206 of the groove 174 of the face 104. In the first orientation, at least a portion of the pair of smooth surfaces 164 and the first surface 166 of the sole plate 140 are flush with the ground facing surface 208 of the groove 174. Additionally, though not visible in FIG. 15, when the sole plate 140 is secured to the body 102 in the first orientation, the front support member 214 is engaged with the front support interface 264.

Figure 16:
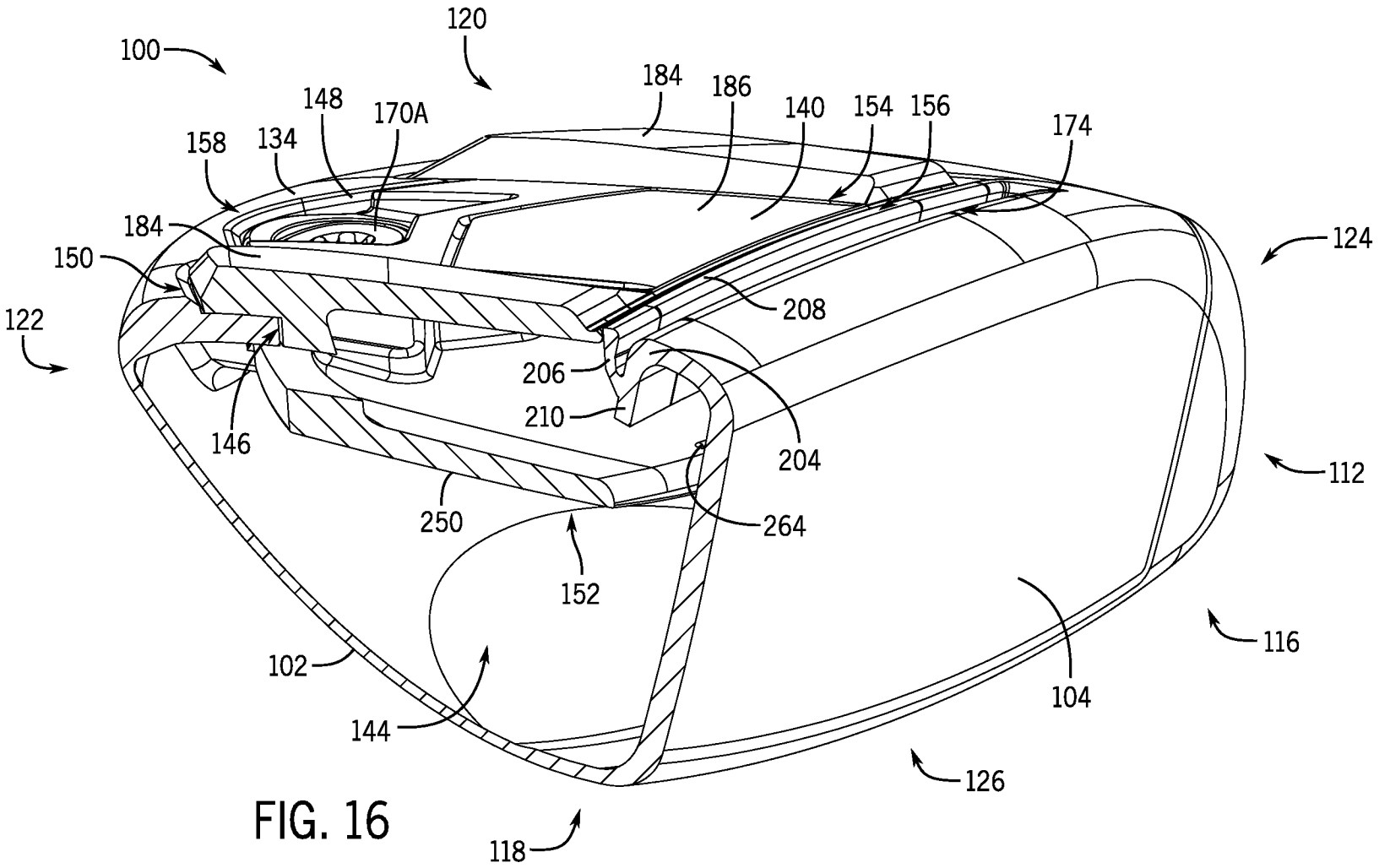
FIG. 16 is a cross-sectional view of the golf club head assembled with the sole plate in the second orientation taken along line 15-15 of FIG. 5.
Figure 17:
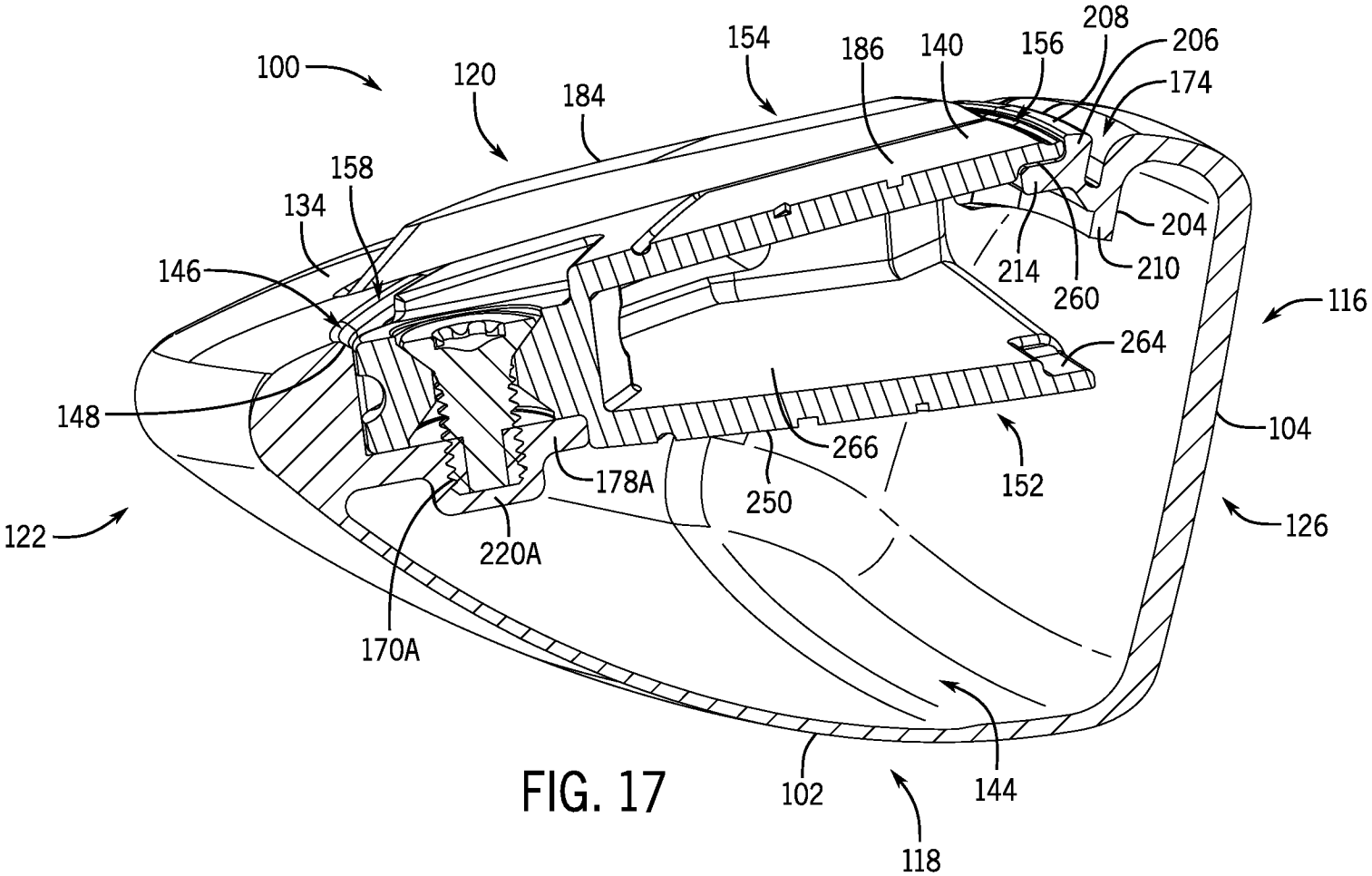
FIG. 17 is a cross-sectional view of the golf club head assembled with the sole plate in the second orientation taken along line 16-16 of FIG. 5.

FIGS. 16 and 17 illustrate the sole plate 140 secured to the body 102 in the second orientation. In the second orientation, the second side 154 of the sole plate 140 faces outward at the bottom side 120 of the golf club head 100. The sole plate 140 is secured to the body 102 so that the pair of rails 184 are seated in the pair of recesses 150 in the bottom side 120 of the golf club head 100. As further illustrated in FIG. 17, when the sole plate 140 is secured to the body 102 in the second orientation, the front support member 214 is engaged with the front support interface 260 formed in the internal surface 262 of the hollow body 250 of the sole plate 140. Similar to the first orientation, in the second orientation at least a portion of the second side 154 of the sole plate 140 is flush with the ground facing surface 208 of the groove 174. Additionally, the first support member 178A of the body 102 is seated within the first fastener recess 230A of the first side 152 of the sole plate 140 in the second orientation.

Figure 18:
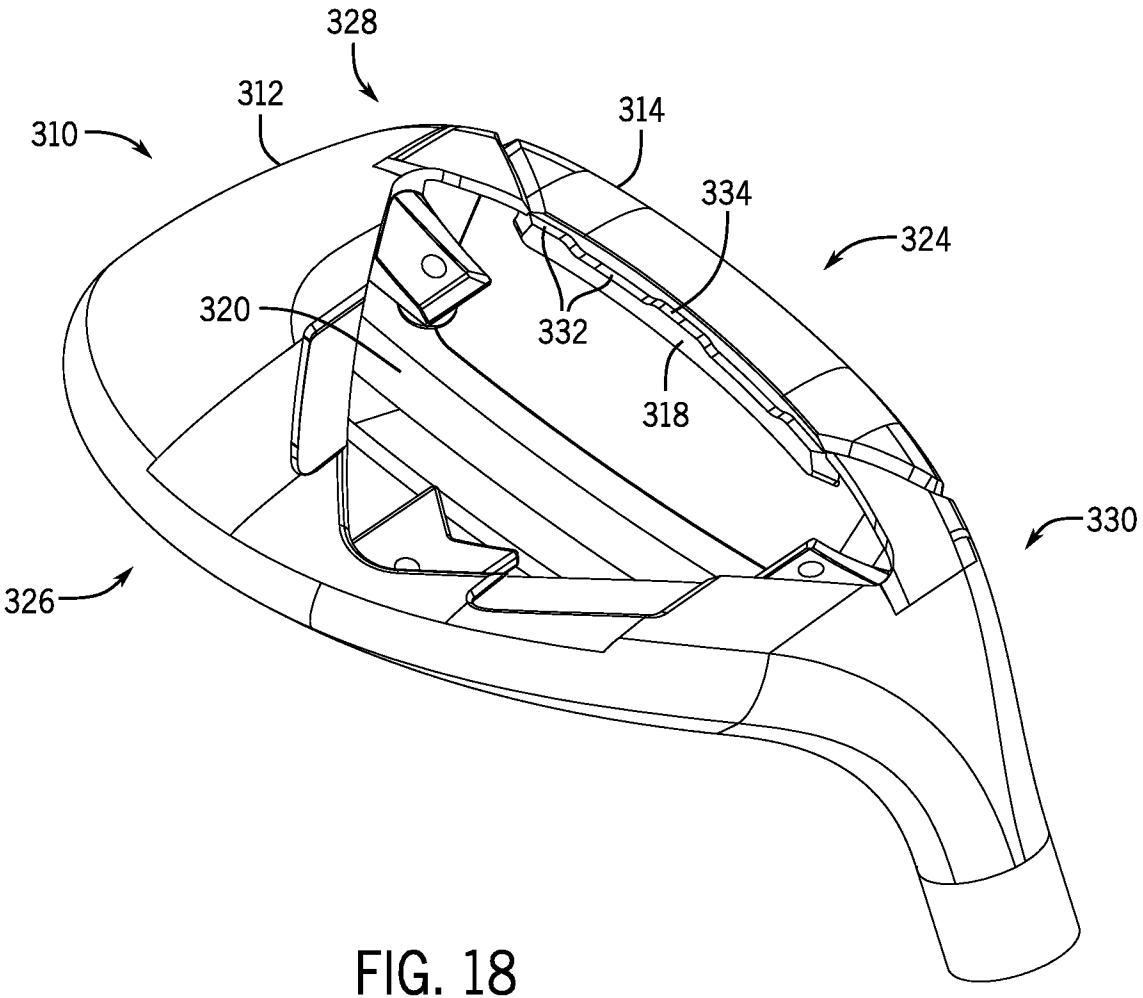
FIG. 18 is a bottom isometric view of a body of a golf club head with a sole plate removed according to another embodiment of the present disclosure.
Figure 19:
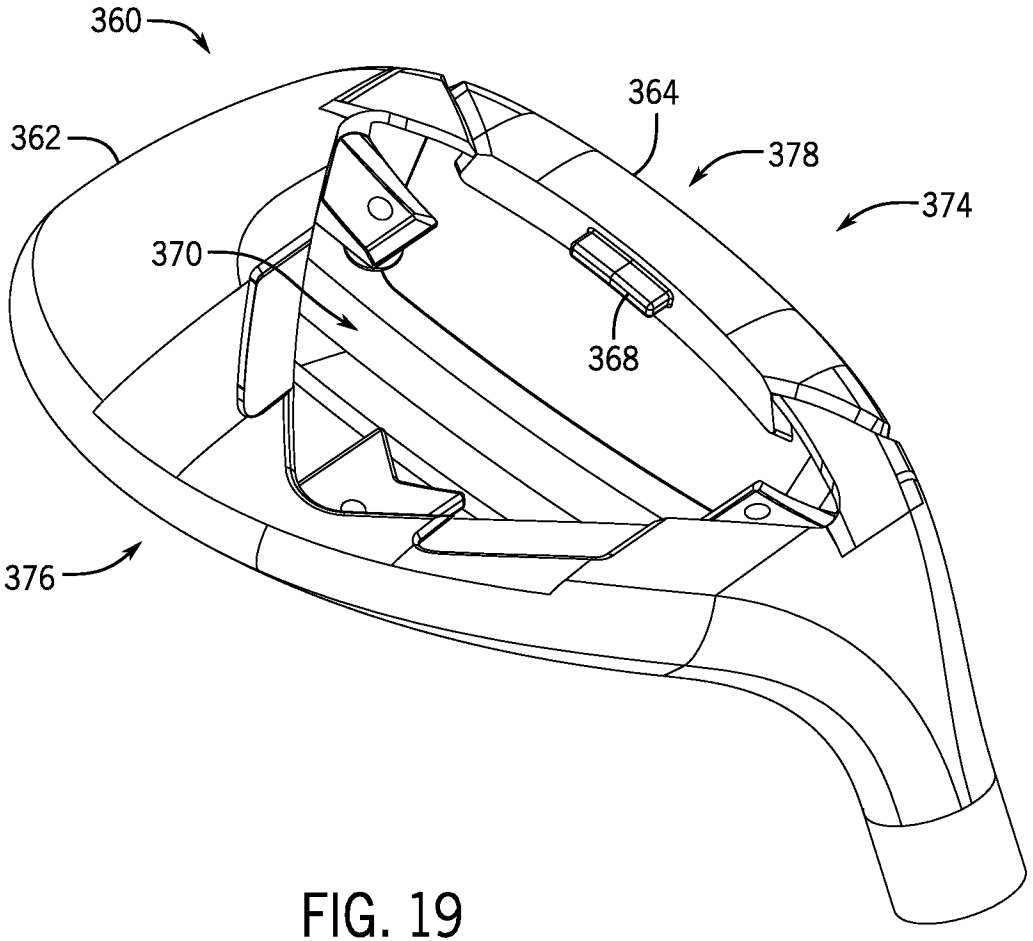
FIG. 19 is a bottom isometric view of a body of a golf club head with a sole plate removed according to another embodiment of the present disclosure.

FIGS. 1-17 illustrate the golf club head 100 according to one embodiment of the disclosure. In other embodiments, a golf club head can include different materials, head types, and geometries that are configured to receive a reversible sole plate in a bottom side of the golf club head. For example, FIGS. 18 and 19 illustrate additional embodiments of golf club heads 310, 360 having a body and a face insert configured to receive a reversible sole plate, such as the sole plate 140. Each body of the golf club heads 310, 360 described below are substantially similar to the body 102 of the golf club head 100, and therefore will not be described in detail.

Referring now to FIG. 18, a golf club head 310 is shown in accordance with the present disclosure. The golf club head 310 is generally configured as a hybrid-type golf club head. The golf club head 310 includes a body 312 and a face insert 314, which may be coupled to one another after machining of the body 312. In some embodiments, the face insert 314 may be manufactured from a different material than the body 312. For example, the body 312 and the face insert 314 may be manufactured from different metal materials (e.g., different types of stainless steel). In some embodiments, the face insert 314 may be initially formed from a variety of manufacturing processes such as printing or casting, for example. After the initial forming, the face insert 314 can be machined to a desired geometry and cross-sectional thickness.

The face insert 314 illustrated in FIG. 18 includes a front support member 318 extending into a cavity 320 of the body 312. The front support member 318 may be machined into the face insert 314 after an initial manufacturing process. Similar to the front support member 214 of the golf club head 100, the front support member 318 extends from the face insert 314 at a front side 324 of the golf club head 310 to a rear side 326 of the golf club head 310. In the illustrated embodiment, the front support member 318 is generally configured as a ledge that extends between a toe side 328 of the golf club head 310 and a heel side 330 of the golf club head 310. The ledge of the front support member 318 includes a plurality of stepped surfaces 332 including a central ridge 334. The central ridge 334 is configured to engage a corresponding alignment and support interface of a sole plate, such as either of the front support interfaces 264, 260 of the sole plate 140 when the sole plate 140 is secured to the body 312 in one of the first or second orientations, respectively.

The face insert 314 can generally be configured as an L-cup insert (e.g., the cross sectional profile of the face insert 314 forms an "L" shape). As shown in FIG. 18, the insert 314 can extend between the toe side 328 and the heel side 330 of the golf club head 310 and can include an unsupported section adjacent to the support member 318. Such unsupported section can extend into the cavity and not contact the body 312 of the golf club head 310. The unsupported back-facing edge of the face insert 314 can promote face flexure during use, which in some instances, can advantageously affect ball speed and launch during mis-hits.

Referring now to FIG. 19, a golf club head 360 is shown in accordance with the present disclosure. The golf club head 360 is generally configured as a hybrid-type golf club head. The golf club head 360 includes a body 362 and a face insert 364, which may be coupled to one another after machining of the body 362. In some embodiments, the face insert 364 may be manufactured from a different material than the body 362. For example, the body 362 and the face insert 364 may be manufactured from different metal materials. In some embodiments, the face insert 364 may be initially formed from a variety of manufacturing processes such as printing or casting, for example. After the initial forming, the face insert 364 can be machined to a desired geometry and cross-sectional thickness.

The face insert 364 illustrated in FIG. 19 includes a front support member 368 extending into a cavity 370 of the body 362. Similar to the front support member 214 of the golf club head 100, the front support member 368 extends from the face insert 364 at a front side 374 of the golf club head 360 to a rear side 376 of the golf club head 360. In the illustrated embodiment, the front support member 368 is generally configured as a tab near a medial region 378 of the golf club head 360. The front support member 368 is configured to engage a corresponding alignment and support interface of a sole plate, such as either of the front support interfaces 264, 260 of the sole plate 140 when the sole plate 140 is secured to the body 312 in a plurality of arrangements, respectively.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

The invention claimed is:

1. A golf club head, comprising:

a body including a toe region, a heel region, and a pair of recesses, the body defining an opening to an internal cavity of the body, the opening surrounded by a perimeter, the pair of recesses formed in an exterior surface of the golf club head proximate to the perimeter and oriented toward a rear side of the body;

a face arranged at a front side of the body and extending between the toe region and the heel region;

a first support member extending from the body and into the internal cavity; and a sole plate supported by the first support member and secured to the body at the perimeter, the sole plate configured to be secured to the body in a plurality of arrangements, wherein when the sole plate is secured to the body in a first arrangement, a pair of smooth surfaces of the sole plate are aligned with the pair of recesses, and wherein when the sole plate is secured to the body in a second arrangement, a pair of rails that extend from the sole plate extend across the perimeter of the body and are seated in the pair of recesses.

2. The golf club head of claim 1, further comprising:

a second support member extending into the internal cavity from the body, toward the toe region, and recessed relative to the perimeter of the opening; and a third support member extending into the internal cavity from the body, toward the heel region, and recessed relative to the perimeter of the opening, the first support member extending from the body toward the face and recessed relative to the perimeter of the opening.

3. The golf club head of claim 1, wherein the face is a face insert coupled to the body and includes a front support member extending from the face insert and into the internal cavity toward a rear side of the golf club head and recessed relative to the perimeter of the opening.

4. The golf club head of claim 3, wherein the front support member is dimensioned to engage the sole plate at a support interface surface of the sole plate, the support interface surface arranged at a front portion of the sole plate.

5. The golf club head of claim 3, wherein the face includes a groove arranged along a bottom side of the golf club head, the groove extending between the heel region and the toe region and including a front wall and a back wall, and wherein the front support member extends from the back wall of the groove.

6. The golf club head of claim 1, wherein the sole plate is hollow and includes weight retainers formed therein, the weight retainers configured to secure one or more removable weights to the sole plate so that the golf club head can define a first center of gravity when the sole plate is secured to the body in a first arrangement and the golf club head can define a second center of gravity when the sole plate is secured to the body in a second arrangement.

7. The golf club head of claim 1, wherein the first support member is configured as a rear support member and defines a distal perimeter, the distal perimeter geometrically similar to first and second mount recesses formed in the sole plate, wherein when the first mount recess is aligned with the rear support member, the sole plate is secured to the body in a first arrangement, and wherein when the second mount recess is aligned with the rear support member, the sole plate is secured to the body in a second arrangement.

8. The golf club head of claim 1, wherein when the sole plate is secured to the body in the second arrangement, the pair of rails extend within the internal cavity and form a gap, the gap formed between the pair of rails and the body within the cavity.

9. The golf club head of claim 1, wherein the sole plate defines a front perimeter that is symmetric about a vertical axis and symmetric about a horizontal axis.

10. A customizable sole plate for a golf club head, the golf club head having a pair of recesses and an opening to an internal cavity that is surrounded by a perimeter, the pair of recesses proximate to the perimeter, the customizable sole plate comprising:

a body defining a front portion and a rear portion and having a first side and a second side, at least one of the first side and the second side including:

a first fastener recess adjacent to the rear portion;

a second fastener recess adjacent to the front portion; and a third fastener recess adjacent to the front portion;

a first front rounded corner of the body formed by the second fastener recess;

a second front rounded corner of the body formed by the third fastener recess;

a pair of smooth surfaces on the first side of the body; and a pair of rails that extend from the second side of the body, wherein the first fastener recess of the first side is opposite the first fastener recess of the second side, the second fastener recess of the first side is opposite the second fastener recess of the second side, and the third fastener recess of the first side is opposite the third fastener recess of the second side, and wherein when the sole plate is secured to the golf club head in a first arrangement, the pair of rails of the body extend across the perimeter of the golf club head and are seated in the pair of recesses.

11. The customizable sole plate of claim 10, wherein the body includes a weight retainer configured to receive one or more removable weights to customize the mass of the body and adjust the center of gravity of the golf club head when the body is secured to the golf club head.

12. The customizable sole plate of claim 11, wherein one of the plurality of configurations of the customizable sole plate secured to the golf club head includes a first removable weight secured to the body via the weight retainer to provide a center of gravity of the golf club head at a first location and another of the plurality of configurations of the customizable sole plate secured to the golf club head includes a second removable weight secured to the body via the weight retainer to provide a center of gravity of the golf club head at a second location.

13. The customizable sole plate of claim 11, wherein the weight retainer is a pocket formed in the customizable sole plate, the pocket dimensioned to receive one or more removable weights via an opening in a front portion of the customizable sole plate when the customizable sole plate is unsecured from the golf club head.

14. The customizable sole plate of claim 11, wherein the body is a hollow and includes a side channel and a front opening, the side channel extending between the first front rounded corner and the second front rounded corner around a rear rounded corner, and wherein the one or more removable weights are inserted into the body via the front opening and secured to the customizable sole plate.

15. The customizable sole plate of claim 14, wherein the first fastener recess of the first side and the first fastener recess of the second side are spaced apart by the side channel.

16. The customizable sole plate of claim 10, wherein first, second, and third fastener holes extend between each corresponding first fastener recesses, second fastener recesses, and third fastener recesses.

17. The customizable sole plate of claim 10, further comprising:

an opening between the first side and the second side at the front portion;

a first front support interface surface formed in an interior surface of the first side adjacent to the opening; and a second front support interface surface formed in an interior surface of the second side adjacent to the opening, the first front support interface surface configured to engage a front support member of the golf club head when the sole plate is in a first configuration, and the second front support interface surface configured to engage the front support member of the golf club head when the sole plate is in a second configuration.

18. The customizable sole plate of claim 10, wherein a front perimeter of the sole plate defines a first radius of curvature at the first side and a second radius of curvature at the second side, wherein the first radius of curvature is equal to the second radius of curvature.

19. A method of customizing a sole plate of a golf club head the golf club head having a pair of recesses and an opening to an internal cavity that is surrounded by a perimeter, the pair of recesses proximate to the perimeter, the method comprising:

removing a first fastener from a first fastener recess of a first side of the sole plate;

separating the sole plate from a body of the golf club head;

rotating the sole plate about a rotation axis defined by the sole plate or inserting one or more weights into a weight retainer formed within the sole plate; and securing the sole plate to the body of the golf club head by securing the first fastener to a first fastener recess of a second side of the sole plate so that a pair of rails extending from the second side of the sole plate extend across the perimeter of the opening of the golf club head and are seated in the pair of recesses, the second side of the sole plate opposite the first side of the sole plate.

* * * * *